US010119281B2

(12) United States Patent
Connell

(10) Patent No.: US 10,119,281 B2
(45) Date of Patent: Nov. 6, 2018

(54) JOINT EDGE ASSEMBLY AND FORMWORK FOR FORMING A JOINT, AND METHOD FOR FORMING A JOINT

(71) Applicant: Illinois Tool Works Inc., Glenview, IL (US)

(72) Inventor: Robert U. Connell, Atlanta, GA (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 15/410,290

(22) Filed: Jan. 19, 2017

(65) Prior Publication Data

US 2017/0321439 A1 Nov. 9, 2017

Related U.S. Application Data

(60) Provisional application No. 62/333,494, filed on May 9, 2016.

(51) Int. Cl.

| | |
|---|---|
| ***E04B 2/82*** | (2006.01) |
| ***E04B 9/00*** | (2006.01) |
| ***E04G 1/22*** | (2006.01) |
| ***E04G 11/48*** | (2006.01) |
| ***E04B 5/36*** | (2006.01) |
| ***E01C 11/02*** | (2006.01) |
| ***E01C 11/14*** | (2006.01) |
| ***E04B 1/48*** | (2006.01) |
| ***E04G 21/18*** | (2006.01) |

(Continued)

(52) U.S. Cl.

CPC ..... *E04G 11/48* (2013.01); *E01C 11/02* (2013.01); *E01C 11/14* (2013.01); *E04B 1/483* (2013.01); *E04B 5/32* (2013.01); *E04B 5/36* (2013.01); *E04G 21/185* (2013.01); *E04B 2005/322* (2013.01); *E04B 2005/324* (2013.01); *E04C 5/0645* (2013.01); *H05K 999/99* (2013.01)

(58) Field of Classification Search

CPC ..... E04G 11/48; E04G 17/14; E04C 19/502; E04B 5/36; E04B 1/161

See application file for complete search history.

(56) References Cited

U.S. PATENT DOCUMENTS

| | | |
|---|---|---|
| 602,769 A | 4/1898 | Parker |
| 811,560 A | 2/1906 | Hinchman |

(Continued)

FOREIGN PATENT DOCUMENTS

| | | |
|---|---|---|
| AT | 348222 | 6/1978 |
| AU | 2013202091 | 10/2013 |

(Continued)

OTHER PUBLICATIONS

American Concrete Pavement Association, "Design and Construction of Joints for Concrete Highways" (1991) (16 Pages).

(Continued)

*Primary Examiner* — Brian D Mattei

(74) *Attorney, Agent, or Firm* — Neal, Gerber & Eisenberg LLP

(57) ABSTRACT

Various embodiments of the present disclosure provides a joint edge assembly and a reusable multiple position height adjuster and method of positioning and installing joint edge assembly and the reusable multiple position height adjuster for forming two adjacent concrete slabs and a joint between such adjacent concrete slabs.

11 Claims, 14 Drawing Sheets

(51) Int. Cl.
*E04B 5/32* (2006.01)
*E04C 5/06* (2006.01)

(56) References Cited

U.S. PATENT DOCUMENTS 828,550 A 8/1906 Inman et al.
881,762 A 3/1908 Adreon, Jr.
920,808 A 5/1909 Alcott
1,298,018 A 3/1919 Davis
1,348,060 A * 7/1920 Sheppard ..... E01C 19/502 238/315
1,557,165 A 10/1925 Hooper
1,632,395 A 6/1927 Fellows
1,672,760 A * 6/1928 Heltzel ..... E01C 19/502 249/208
1,753,316 A 4/1930 Robertson
1,755,541 A * 4/1930 Heltzel ..... E01C 19/502 249/6
1,894,395 A 1/1933 Burrell
1,918,710 A * 7/1933 Mosel ..... E01C 19/502 104/306
1,944,511 A * 1/1934 Heltzel ..... E01C 19/502 249/6
1,956,046 A 4/1934 Robertson
2,064,528 A 12/1936 Fischer
2,103,337 A 12/1937 Oury
2,121,303 A 6/1938 Robertson
2,149,467 A 3/1939 Robertson
2,167,904 A 8/1939 Older
2,181,005 A 11/1939 Westcott
2,193,129 A 3/1940 Geyer et al.
2,201,134 A 5/1940 Brickman et al.
2,207,168 A 7/1940 Thomas et al.
2,210,356 A 8/1940 Bauer
RE21,996 E 1/1942 Oates
2,308,677 A 1/1943 Dailey
2,309,538 A 1/1943 Robertson
2,316,233 A 4/1943 Fischer
2,319,972 A 5/1943 Brickman
2,349,983 A 5/1944 Musall
2,416,584 A 2/1947 Heltzel
2,441,903 A 5/1948 Robertson
2,489,851 A 11/1949 Bean
2,509,180 A 5/1950 Yeoman
2,531,040 A 11/1950 Heltzel
2,589,815 A 3/1952 Jacobson
2,636,426 A 4/1953 Heltzel
2,654,297 A 10/1953 Nettleton
2,745,165 A 5/1956 Lewis
2,775,924 A 1/1957 Brickman
2,780,149 A 2/1957 Heltzel
2,875,500 A * 3/1959 Stough ..... E01C 19/502 249/6
3,104,600 A 9/1963 White
3,246,433 A 4/1966 Eriksson
3,372,521 A 3/1968 Thom
3,430,406 A 3/1969 Weber
3,434,263 A 3/1969 Beckman et al.
3,527,009 A 9/1970 Nyquist
3,559,541 A 2/1971 Watstein
3,561,185 A 2/1971 Finsterwalder et al.
3,614,051 A * 10/1971 Trimmer ..... E04G 11/02 249/194
3,745,726 A 7/1973 Thom
3,855,754 A 12/1974 Scoville et al.
3,964,219 A 6/1976 Hala
4,021,984 A 5/1977 Honegger
4,091,589 A 5/1978 Moot
4,257,207 A 3/1981 Davis
4,353,666 A 10/1982 Brandley
4,373,829 A 2/1983 Braxell
4,453,360 A 6/1984 Barenberg
4,548,009 A 10/1985 Dahowski
4,733,513 A 3/1988 Schrader et al.
4,804,292 A 2/1989 DeLuca
4,883,385 A 11/1989 Kaler
4,904,111 A 2/1990 Weisbach
4,996,816 A 3/1991 Wiebe
5,005,331 A 4/1991 Shaw et al.
5,216,862 A 6/1993 Shaw et al.
5,261,635 A 11/1993 Flathau
5,337,534 A 8/1994 Nasca
5,366,319 A 11/1994 Hu et al.
5,419,057 A 5/1995 Jackson
5,419,965 A 5/1995 Hampson
5,458,433 A 10/1995 Stastny
5,487,249 A 1/1996 Shaw et al.
5,674,028 A 10/1997 Norin
5,713,174 A 2/1998 Kramer
5,730,544 A 3/1998 Dils et al.
5,766,645 A * 6/1998 Kaminski ..... B28B 7/0017 249/120
5,797,231 A 8/1998 Kramer
5,934,821 A 8/1999 Shaw et al.
5,941,045 A 8/1999 Plehanoff et al.
6,019,546 A 2/2000 Ruiz
6,021,994 A * 2/2000 Shartzer, Jr. ..... E01C 19/502 249/189
6,036,165 A * 3/2000 Lee ..... E04G 11/08 249/19
6,052,964 A 4/2000 Ferm et al.
6,145,262 A 11/2000 Schrader et al.
6,195,956 B1 3/2001 Reyneveld
6,354,053 B1 3/2002 Kerrels
6,354,760 B1 3/2002 Boxall et al.
6,471,441 B1 10/2002 Müller
6,502,359 B1 1/2003 Rambo
6,532,714 B1 3/2003 Ferm et al.
6,536,737 B1 * 3/2003 Davis ..... E04G 13/00 249/210
6,775,952 B2 8/2004 Boxall et al.
6,874,288 B1 4/2005 Washa et al.
6,926,463 B2 8/2005 Shaw et al.
7,004,443 B2 2/2006 Bennett
7,201,535 B2 4/2007 Kramer
7,228,666 B2 6/2007 Michiels
7,338,230 B2 3/2008 Shaw et al.
7,441,985 B2 10/2008 Kelly et al.
7,481,031 B2 1/2009 Boxall et al.
7,716,890 B2 5/2010 Boxall et al.
7,736,088 B2 6/2010 Boxall et al.
8,302,359 B2 11/2012 Boxall et al.
8,303,210 B2 11/2012 Parkes et al.
8,381,470 B2 2/2013 Boxall et al.
9,458,638 B2 10/2016 Parkes et al.
2003/0033778 A1 2/2003 Boxall et al.
2004/0093817 A1 * 5/2004 Pujol Barcons ..... E02D 27/01 52/294
2006/0177267 A1 8/2006 Carroll
2007/0231068 A1 10/2007 Francies et al.
2009/0045316 A1 * 2/2009 Von Limburg ..... B28B 7/0017 249/1
2013/0283721 A1 * 10/2013 Ahn ..... E04B 1/24 52/649.6

FOREIGN PATENT DOCUMENTS

BE 1015453 4/2005
CH 594106 12/1977
DE 152821 7/1904
DE 726829 10/1942
DE 894706 10/1953
DE 3424362 1/1986
DE 3440828 5/1986
DE 3808148 9/1989
EP 0032105 7/1981
EP 0059171 9/1982
EP 0328484 8/1989
EP 0410079 1/1991
EP 1389648 2/2004
FR 2785632 5/2000
GB 2285641 7/1995
GB 2500626 10/2013

(56) References Cited

FOREIGN PATENT DOCUMENTS

| | | |
|---|---|---|
| GB | 2507071 | 4/2014 |
| GB | 2511729 | 7/2014 |
| GB | 2530344 | 3/2016 |
| WO | WO9639564 | 12/1996 |
| WO | WO9931329 | 6/1999 |
| WO | WO2004065694 | 8/2004 |
| WO | WO2013/076500 | 5/2013 |
| WO | WO2014/060752 | 4/2014 |
| WO | WO2014/111712 | 7/2014 |

OTHER PUBLICATIONS

American Concrete Pavement Association, "Design and Construction of Joints for Concrete Streets", (1992) (11 Pages).
American Concrete Institute, ACI Committee 302, "Guide for Concrete Floor and Slab Construction", ACI 302.1R-96 (1997) (17 Pages).
Laser Form pamphlet entitled: "Who's going to use Laser Form first? You or your competition?" (Available Prior to Oct. 15, 2015) (6 pages).
PNA Construction Technologies, "PNA Square Dowel Basket Isometric," Current, Sheet SDB-1, Jun. 2004, Atlanta, GA (1 Page).
ACI Committee 360, "Design of Slabs-on-Ground, ACI 260R-06," Aug. 9, 2006 (pp. 360R-1 to 360R-74).
ACI Committee 302, "Guide for Concrete Floor and Slab Construction, ACI 302.1R-04," Mar. 23, 2004 (pp. 302.1R-1 to 302.1R-77).
Wayne W. Walker and Jerry A. Holland, "Performance-Based Dowel Design, Lift-truck design changes require a new look at joint durability," Concrete Construction—The World of Concrete, Jan. 2007 World of Concrete Official Show Issue, Hanley Wood (pp. 1-8).
Nigel Parkes, "A Decade of Dowel Development," L&M Concrete News, Jan. 2007: vol. 7, No. 1 (pp. Cover, 8-10).
Wayne W. Walker and Jerry A. Holland, "Plate Dowels for Slabs on Ground," American Concrete Institute—Concrete International, Jul. 1998 (pp. Cover, 32-38).
Ernest K. Schrader, "A Solution to Cracking and Stresses Caused by Dowels and Tie Bars," American Concrete Institute—Concrete International, Jul. 1991 (6 pages).
Greg K. Fricks and Nigel K. Parkes, "Innovations for Durable Floors," Concrete Construction, The World of Concrete, Jan. 2002 by Hanley-Wood Publication (4 pages).
Gregory Scurto, David Scurto, Wayne W. Walker, and Jerry A. Holland, "Cost-Effective Slabs-on-Ground," American Concrete Institute—Concrete International, May 2004 (pp. 65-67).
PNA Construction Technologies, "Square Dowel Baskets," Current, printed from PNA website found under "Products" (Available Prior to Oct. 15, 2015) (1 Page).
PNA Construction Technologies, "PD3 Basket Assembly Instructions for Use," Source: American Concrete Association, R&T Update, "Dowel Basket Tie Wires: Leaving Them Intact Does Not Affect Pavement Performance," Jan. 2005 (1 Page).
PNA Construction Technologies, "PD3 Basket Assembly," Source Material: Concrete Construction, "Performance-Based Dowel Design," Jan. 2007, Wayne Walker and Jerry Holland (1 Page).
PNA Construction Technologies, "PNA PD3 Basket Assembly Isometric," Current, Sheet PD3-1, Aug. 2006, Atlanta, GA (1 Page).
Wayne W. Walker and Jerry A. Holland, Thou Shalt Not Curl nor Crack . . . (hopefully), Concrete International, Jan. 1999 (7 Pages).
Steve Metzger and Metzger/McGuire, "Handling Joints in Industrial Concrete Floors," World of Concrete 2005, Las Vegas, NV (28 Pages).
Nigel K. Parkes, "Improved Load Transfer and Reduced Joint Spalling Systems for both Construction and Contraction Joints," International Colloquium of Industrial Floors, Jan. 2003, Esslingen, Germany (11 Pages).
Greg K. Fricks and Nigel K. Parks, "Innovations for Durable Floors," Concrete Construction, The World of Concrete, Jan. 2002 by Hanley-Wood Publication (4 Pages).
Nigel Parkes, "Designing the Cost-Effective Slab-on-Ground Least Likely to Crack or Spall," Structure Magazine, Apr. 2007 (pp. 10-12).
Shrader, "A Proposed Solution to Cracking Caused by Dowels," Concrete Construction, Dec. 1987 (2 Pages).
William F. Perenchino, Avoiding Common Mistakes in Concrete Joint Design, Construction Renovation Facilities, reprinted from Plant Engineering, Jan. 11, 1990, Cahners Publishing Company (5 Pages).
William Van Breemen and E. A. Finney, "Design and Construction of Joints in Concrete Pavements," Journal of the American Concrete Institute, Jun. 1950 (pp. 789-819).
Arnold, "Diamond Dowels for Slabs on Ground," Concrete, Jun. 1998 (2 Pages).
E. A. Finney, "Structural Design Considerations for Pavement Joints," Title No. 53-1, part of copyrighted Journal of the American Concrete Institute, V. 28, No. 1, Jul. 1956 (pp. 1-27).
Portland Cement Association, Concrete Floors on Ground, 2d ed. 1983 (41 Pages).
The Concrete Society, Technical Report No. 34: Concrete Industrial Ground Floors, 3d ed., 2003 (8 Pages).
Greenstreak, "Laser Form Job Site Guide" (Available Prior to Oct. 15, 2015) (2 Pages).
Arnold, "Joint Armouring and Load Transfer," Concrete, Sep. 2006 (2 Pages).
Ralph E. Spears, "Concrete Floors on Ground", Portland Cement Association, Second Edition, 1983 (14 Pages).
Guide for Concrete Floor and Slab Construction, Reported by ACI Committee 302, American Concrete Institute (Available Prior to Oct. 15, 2015) (2 Pages).
ACI Committee 306, Technical Manual, 1997 (28 Pages).
Sheet#AE-2, Armor-Edge® n2e Joint Assembly Installation New to Existing Slab-Construction Joints, PNA Construction Technologies, Aug. 2006 (1 Page).
Technical Data Sheet: TDS 001-REV2, Armourjoint, www.armourjoint.com (Available Prior to Oct. 15, 2015) (2 Pages).
Isedio Floor Joint Solutions—Armourjoint, Shieldjoint and Steeldeckjoint, www.isedio.com, Mar. 23, 2016 (5 Pages).
European Patent Office as International Searching Authority, International Search Report and Written Opinion for PCT Application No. PCT/US2016/055315 dated Dec. 13, 2016 (10 Pages).
Elstner, Richard C. and Hognestad, Eivind, "Shearing Strength of Reinforced Concrete Slabs," Journal of the American Concrete Institute, V. 28, No. 1, Jul. 1956 (pp. 29-58).
European Patent Office as International Searching Authority, International Search Report and Written Opinion for PCT Application No. PCT/US2017/021360 dated May 22, 2017 (14 Pages).

* cited by examiner

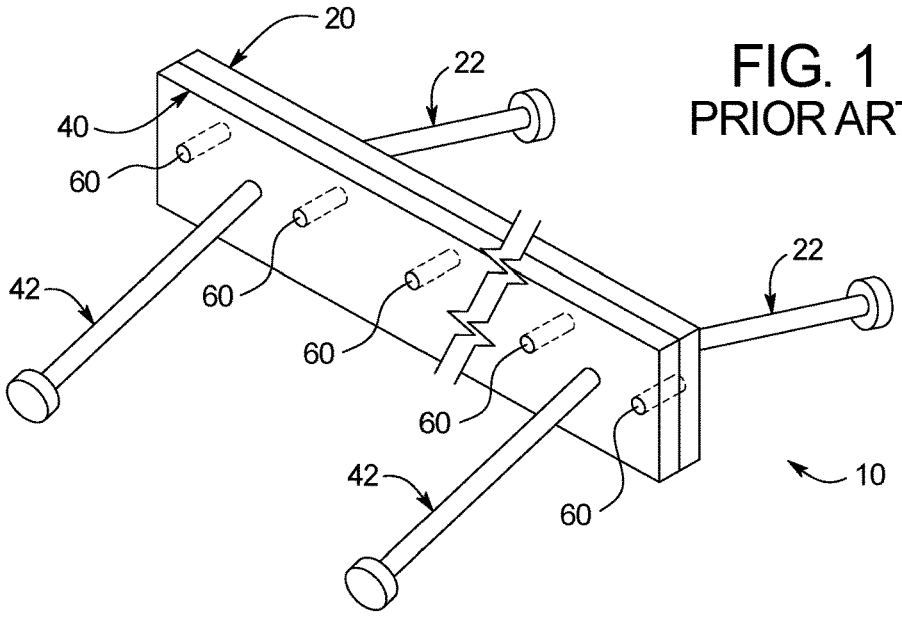
FIG. 1
PRIOR ART
FIG. 2
PRIOR ART
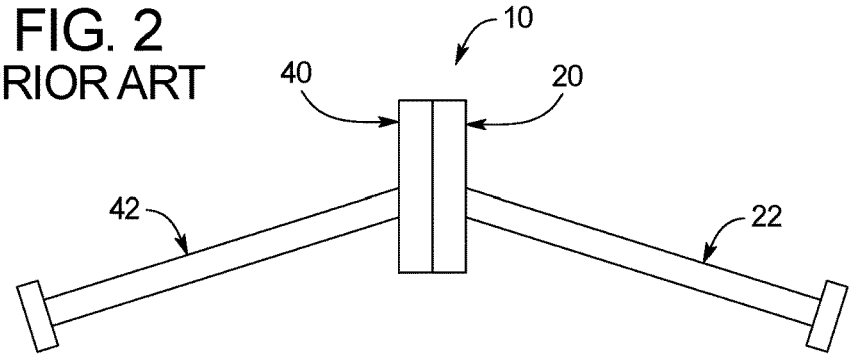
FIG. 3
PRIOR ART
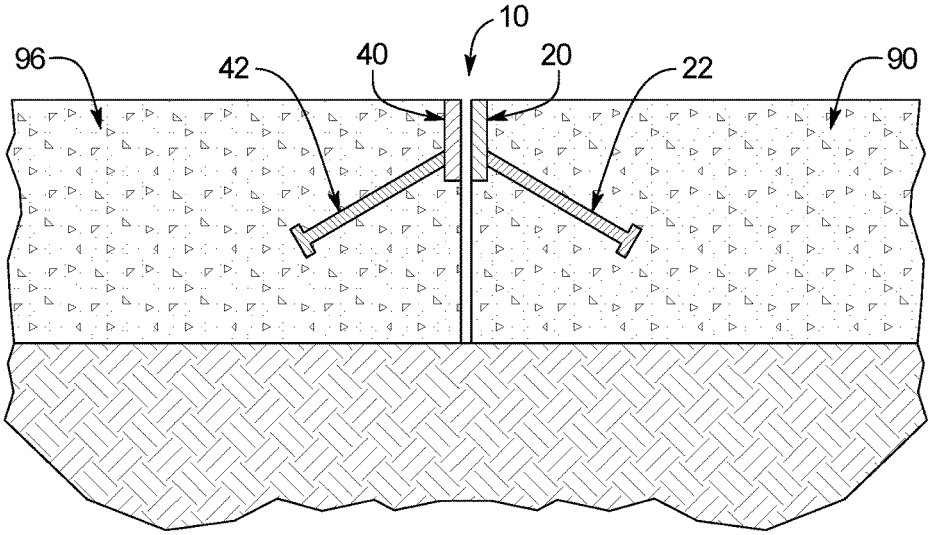

JOINT EDGE ASSEMBLY AND FORMWORK FOR FORMING A JOINT, AND METHOD FOR FORMING A JOINT

PRIORITY CLAIM

This application claims priority to and the benefit of U.S. Provisional Patent Application Ser. No. 62/333,494, filed May 9, 2016, the entire contents of which are incorporated herein by reference.

BACKGROUND

For various logistical and technical reasons, concrete floors are typically made up of a series of individual concrete blocks or slabs. The interface where one concrete block or slab meets another concrete block or slab is typically called a joint. Freshly poured concrete shrinks considerably as it hardens due to the chemical reaction that occurs between the cement and water (i.e., hydration). As the concrete shrinks, tensile stress accumulates in the concrete. Therefore, the joints need to be free to open or expand and thus enable shrinkage of each of the individual concrete blocks or slabs without damaging the concrete floor.

The joint openings, however, create discontinuities in the concrete floor surface, which can cause the wheels of a vehicle (such as a forklift truck) to impact the edges of the concrete blocks or slabs, which form the joint, and chip small pieces of concrete from the edge of each concrete block or slab, particularly if the joint edges are not vertically aligned. This damage to the edges of concrete blocks or slabs is commonly referred to as joint spalling. Joint spalling often interrupts the normal working operations of many facilities by slowing down forklift and other truck traffic, and/or causing damage to trucks and the products the trucks carry. Severe joint spalling and uneven joints can cause loaded forklift trucks to overturn (which of course is dangerous to people in those facilities). Joint spalling can also be very expensive and time consuming to repair.

Joint edge assemblies that protect such joints between concrete blocks or slabs are widely used in the construction of concrete floors (such as concrete floors in warehouses). Examples of known joint edge assemblies are described in U.S. Pat. Nos. 6,775,952 and 8,302,359. Various known joint edge assemblies enable the joint edges to both self-open with respect to the opposite joint edge as the adjacent concrete slabs shrink during hardening.

One known joint edge assembly is generally illustrated in FIGS. 1, 2, 3, and 4. This known joint edge assembly 10 includes two separate elongated joint edge members 20 and 40 temporarily held together by a plurality of connectors 60. The connectors 60 connect the elongated joint edge members 20 and 40 along their lengths during installation. This known joint edge assembly 10 further includes a plurality of anchors 22 that extend from the elongated joint edge member 20 into the region where the concrete of the first slab 90 is to be poured such that, upon hardening of the concrete slab 90, the anchors 22 are cast within the body of the concrete slab 90. This known joint edge assembly 10 further includes a plurality of anchors 42 that extend from the elongated joint edge member 40 into the region where the concrete of the second slab 96 is to be poured such that, upon hardening of the concrete slab 96, the anchors 42 are cast within the body of the concrete slab 96. This known joint edge assembly is positioned such that the ends or edges of the concrete slabs are aligned with the respective outer surfaces of the elongated joint edge members. FIGS. 1 and 2 illustrate the joint edge assembly 10 prior to installation and before the concrete is poured, and FIG. 3 illustrates the joint edge assembly 10 after installation and after the concrete slabs have started shrinking such that the elongated joint edge members 20 and 40 have separated to a certain extent and after the joint has partially opened or expanded.

One known problem with this type of known joint edge assembly is that the joint will open too much or too wide as generally shown in FIG. 4 such that the elongated joint edge members 20 and 40 have separated to a greater extent than that shown in FIG. 3. The distance X between the facing sides of the elongated joint edge members 20 and 40, which is the same distance between the facing sides of the concrete slabs 90 and 96 as shown in FIG. 4, can be up to approximately 31.75 millimeters (approximately 1.25 inches) for certain installations. Such wider joints create many problems.

One problem with such wider joints is that as the joint opening becomes wider, the joint allows more engagement by the tires of the vehicles (such as forklift trucks) which can damage the joint and the vehicles. More specifically, wheels or tires with smaller diameters partially enter the joint opening as generally illustrated in FIG. 4 and engage or impact the edge and/or inside wall of the elongated joint edge member such as member 40. This impact causes wear or damage to the rubber wheel or tire of the vehicle. This impact also looses the engagement between the elongated member 40 and the slab 96. A series of these impacts can cause the concrete of the slab 96 behind or under the member 40 to break or crack, and possibly cause partial or complete disengagement of the elongated member 40 from slab 96. It should be appreciated that the same damage can happen to member 20 and slab 90 when the vehicles are moving in that direction.

In some cases, filler materials (such as elastomeric materials) are used to fill the joint opening to form a bridge along a top portion of the joint opening defined between the elongated joint edge members 20 and 40. A problem with such filler materials is that when the concrete slabs 90 and 96 shrink, the joint opening widens, thus causing the filler material to flow from the top portion of the jointing opening to a bottom portion of the joint opening. This flow disintegrates the bridge.

One known attempt at solving these problems is generally illustrated in FIGS. 5, 6, and 7. This known joint edge assembly 110 includes two separate elongated joint edge members 120 and 140 temporarily held together by a plurality of connectors (not shown), which connect the elongated joint edge members 120 and 140 along their lengths during installation. This known joint edge assembly 110 further includes a plurality of anchors 122 that extend from the elongated joint edge member 120 into the region where the concrete of the first slab 190 is to be poured such that, upon hardening of the concrete slab 190, the anchors 122 are integrally cast within the body of the concrete slab 90. This known joint edge assembly 110 further includes a plurality of anchors 142 that extend from the elongated joint edge member 140 into the region where the concrete of the second slab 196 is to be poured such that, upon hardening of the concrete slab 196, the anchors 142 are integrally cast within the body of the concrete slab 196. This known joint edge assembly 110 is positioned such that the ends of the slabs are aligned with the outer surfaces of the elongated joint edge members. A filler material is deposited in the joint between members 120 and 140 to prevent the wheels of the vehicles from entering the joint.

This known joint edge assembly 110 includes an elongated metal plate 180 attached to a bottom edge of the elongated joint member 120. FIG. 5 illustrates the joint edge assembly 110 after installation and immediately after the concrete is poured. The metal plate 180 is positioned to prevent the filler material from leaking into the bottom portion of the joint opening (i.e., the portion of the joint opening below the metal plate 180).

FIG. 6 illustrates the joint edge assembly 110 after installation and after the concrete has started shrinking such that the elongated joint edge members 120 and 140 have separated such that: (a) the distance between the facing sides of the concrete slabs 190 and 196 is X-A; and (b) the distance between the facing sides of the elongated joint edge members 120 and 140 is X-A. In various installations, X-A is approximately 9.525 millimeters (approximately 0.375 inches). As shown in FIG. 6, the metal plate 180 prevents the filler material from leaking into the portion of the joint opening below the metal plate 180.

FIG. 7 illustrates the joint edge assembly 110 after installation and after the concrete has further shrunk. Now the elongated joint edge members 120 and 140 have separated to a greater extent than shown in FIG. 6 such that: (a) the distance between the facing sides of the concrete slabs 190 and 196 is X; and (b) the distance between the facing sides of the elongated joint edge members 120 and 140 is X. In various installations, X is approximately 20 millimeters (approximately 0.80 inches). As can be seen in FIG. 6, when the joint only opens to a limited extent (e.g., distance X-A), the metal plate 180 prevents the filler from leaking to the bottom portion of the joint opening. However, as can be seen in FIG. 7, when the joint opens to a further extent (e.g., distance X), the metal plate 180 does not prevent the filler from entering the bottom portion of the joint opening. Additionally, the metal plate 180 cannot be made longer or substantially longer to prevent this filler leakage without causing weakness in the concrete slab 196. Thus, this known joint assembly works for certain sized joints, such as that shown in FIG. 6, but does not work for larger sized or wider joints, such as that shown in FIG. 7.

Additionally, it is not practical or cost effective to solve this problem by making the elongated joint edge member 120, the elongated joint edge member 140, or the plate 180 wider because these members become too heavy and too costly.

Another problem with various known joint assemblies is that formwork needs to be used to hold the joint edge assembly in place while pouring the concrete slabs. This formwork is often not reusable and not recyclable. Therefore, a tremendous amount of cost and waste typically occurs in forming these types of joints.

Accordingly, there is a need to solve the above problems.

SUMMARY

Various embodiments of the present disclosure provide a joint edge assembly, formwork for forming a joint, and a method of forming a joint, that solve the above problems. In one embodiment, the joint edge assembly of the present disclosure protects the joint edges of adjacent concrete slabs, and enables the joint edges to both self-open and move laterally to a significant extent with respect to the opposite joint edges as the concrete shrinks during hardening. The formwork of the present disclosure is reusable and facilitates the positioning of the joint edge assembly at multiple different heights.

The joint edge assembly of various embodiments of the present disclosure generally includes: (1) a longitudinal joint rail having two separate elongated joint edge members; (2) a plurality of connectors that connect the elongated joint edge members along their length during installation; (3) a plurality of anchors that extend from each of the elongated joint edge members into the regions where the concrete of the slabs are to be poured such that, upon hardening of the concrete slabs, the anchors are cast within the respective bodies of the concrete slabs; and (4) one or more attachment plates or attachers. The reusable formwork of various embodiments of the present disclosure generally includes a reusable multiple position height adjuster and a reusable base.

The method of various embodiments of the present disclosure includes using the reusable multiple position height adjuster and the reusable base to position the joint edge assembly where the joint will be formed before either of the two adjacent concrete slabs are poured. In these embodiments, the reusable multiple position height adjuster facilitates positioning the joint edge assembly at the appropriate height and also facilitates positioning of load transfer members for the adjacent concrete slabs. In these embodiments, the base, the height adjuster, and the elongated joint edge members are positioned such that the elongated joint edge members are positioned along or adjacent to the length of the joint between the adjacent concrete slab sections, and parallel to the ground surface that defines a generally flat reference plane.

More specifically, in these embodiments, the elongated joint edge members are positioned such that: (1) the slab engagement surface of the first joint edge member extends in a first vertical or substantially vertical plane directly adjacent to the vertically extending plane in which the vertically extending side or end surface of the first concrete slab will lie and such that the slab engagement surface of the first joint edge member will engage the vertically extending side or end surface of the first concrete slab after the first concrete slab is poured; (2) the opposite or second slab facing side of the first joint edge member extends in a second vertical or substantially vertical plane inwardly (relative to the second concrete slab) of the vertical plane in which the vertically extending side or end surface of the second concrete slab will lie after the second concrete slab is poured; (3) the first slab facing side of the second joint edge member extends in a third vertical or substantially vertical plane further inwardly (relative to the second concrete slab) of the vertical plane in which the vertically extending side or end surface of the second concrete slab will lie after the second concrete slab is poured; and (4) the slab engagement surface of the second joint edge member extends in a vertical or substantially vertical plane even further inwardly (relative to the second concrete slab) of the vertical plane in which the vertically extending side or end surface of the second concrete slab will lie after the second concrete slab is poured.

This offset position accounts for situations where the joint opens a relatively greater distance, and also prevents filler from leaking into the lower substantial portions of the joint without requiring the elongated joint edge members to be made wider, heavier, or more costly.

The method of various embodiments of the present disclosure further includes positioning the one or more attachment plates or attachers such that: (1) the slab engagement surface of each attacher extends in a vertical or substantially vertical plane inwardly (relative to the first concrete slab) of the vertical plane in which the vertically extending side or end surface of the first concrete slab will lie after the first concrete slab is poured; and (b) the opposite or second slab facing side of each attacher extends in a second vertical or substantially vertical plane aligned with the vertical plane in which the vertically extending side or end surface of the first concrete slab will lie after the first concrete slab is poured.

The method of various embodiments of the present disclosure further includes positioning pockets or block out sheaths in the attachment plates or attachers such that pockets or block out sheaths extend into the end the first concrete slab after the first concrete slab is poured. The method of the present disclosure further includes positioning load transfer members or dowels in the pockets or block out sheaths before the second concrete slab is poured to and such that part of the load transfer members or dowels in the pockets or block out sheaths extend into the areas in which the second concrete slab will be poured. This enables the load transfer members or dowels to be cast in the second concrete slab, and thus move with the second concrete slab relative to the pockets or block out sheaths after the second concrete slab cures.

The method of various embodiments of the present disclosure further includes removing the base and the height adjuster after the first concrete slab at least partially cures and before the second concrete slab is poured.

It should be appreciated from the above that various embodiments of the method of the present disclosure further includes positioning the height adjuster in one of the two different positions based on the desired height of joint assembly.

Additional features and advantages of the present invention are described in, and will be apparent from, the following Detailed Description and the Figures.

BRIEF DESCRIPTION OF THE FIGURES

FIG. 1 is a perspective view of a known joint edge assembly.

FIG. 2 is an end view of the known joint edge assembly of FIG. 1.

FIG. 3 is a cross-sectional view of the known joint edge assembly of FIG. 1 shown mounted to two concrete slabs, and illustrates the separation of the two concrete slabs after they have shrunk to a certain extent.

DETAILED DESCRIPTION OF EXAMPLE EMBODIMENTS

Figure 4:
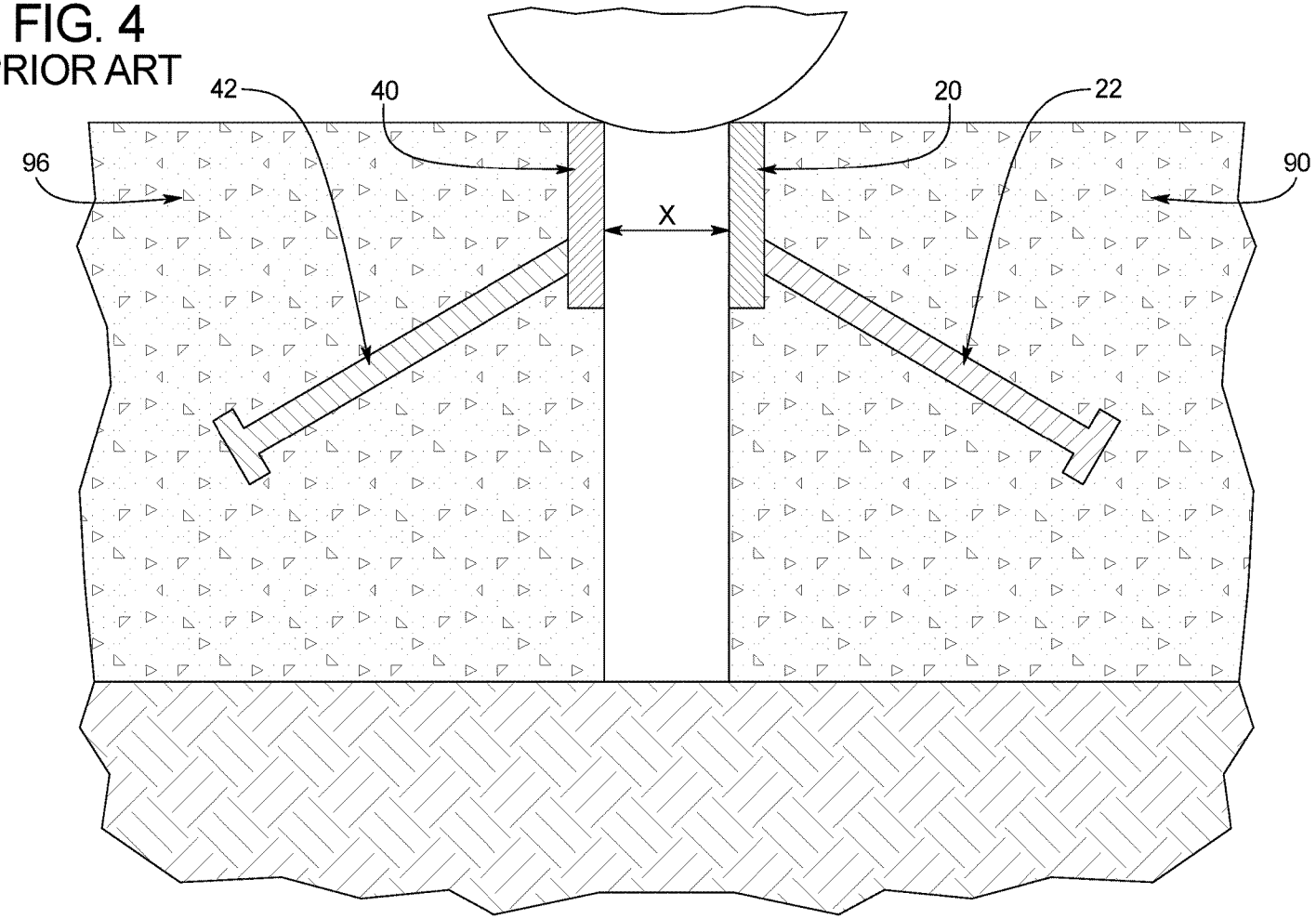
FIG. 4 PRIOR ART
FIG. 4 is a cross-sectional view of the known joint edge assembly of FIG. 1 shown mounted to two concrete slabs, and illustrates the further separation of the two concrete slabs after they have further shrunk to a greater extent than shown in FIG. 3.
Figure 5:
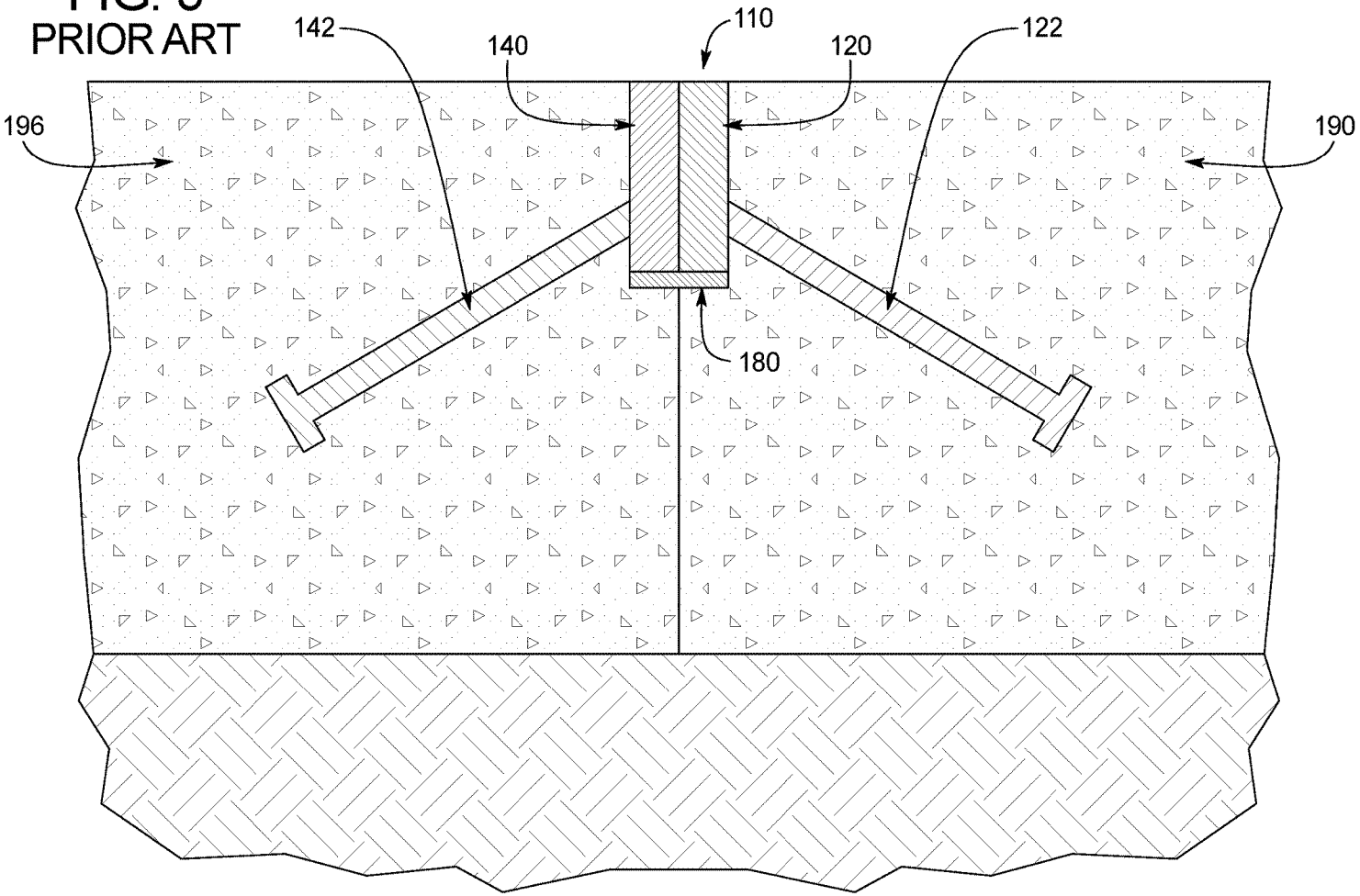
FIG. 5 PRIOR ART
FIG. 5 is a cross-sectional view of another known joint edge assembly shown mounted to two concrete slabs after installation and before the two concrete slabs have shrunk.
Figure 6:
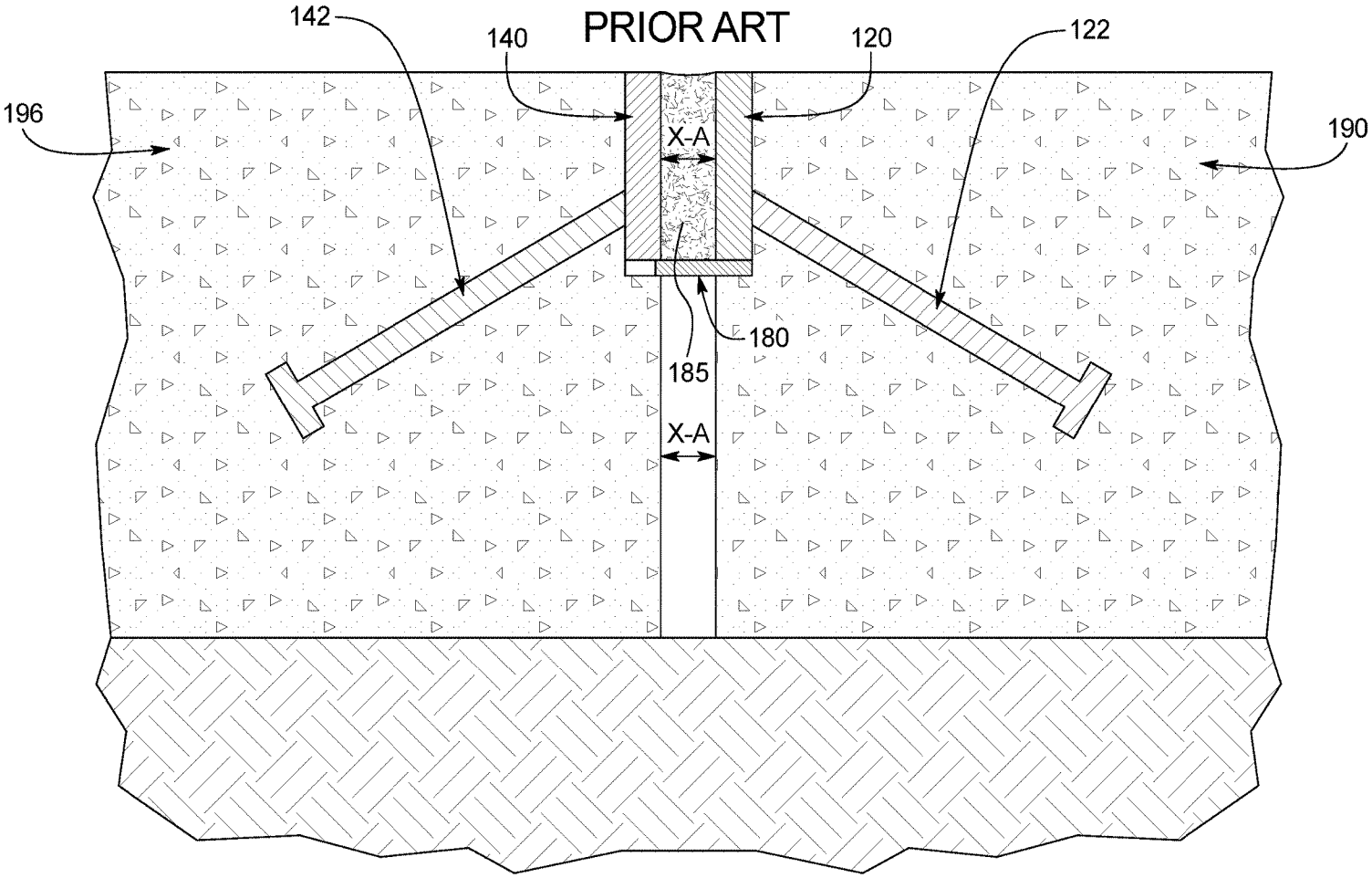
FIG. 6 PRIOR ART
FIG. 6 is a cross-sectional view of the known joint edge assembly of FIG. 5 shown mounted to two concrete slabs, and illustrating the separation of the two concrete slabs after they have shrunk to a certain extent.
Figure 7:
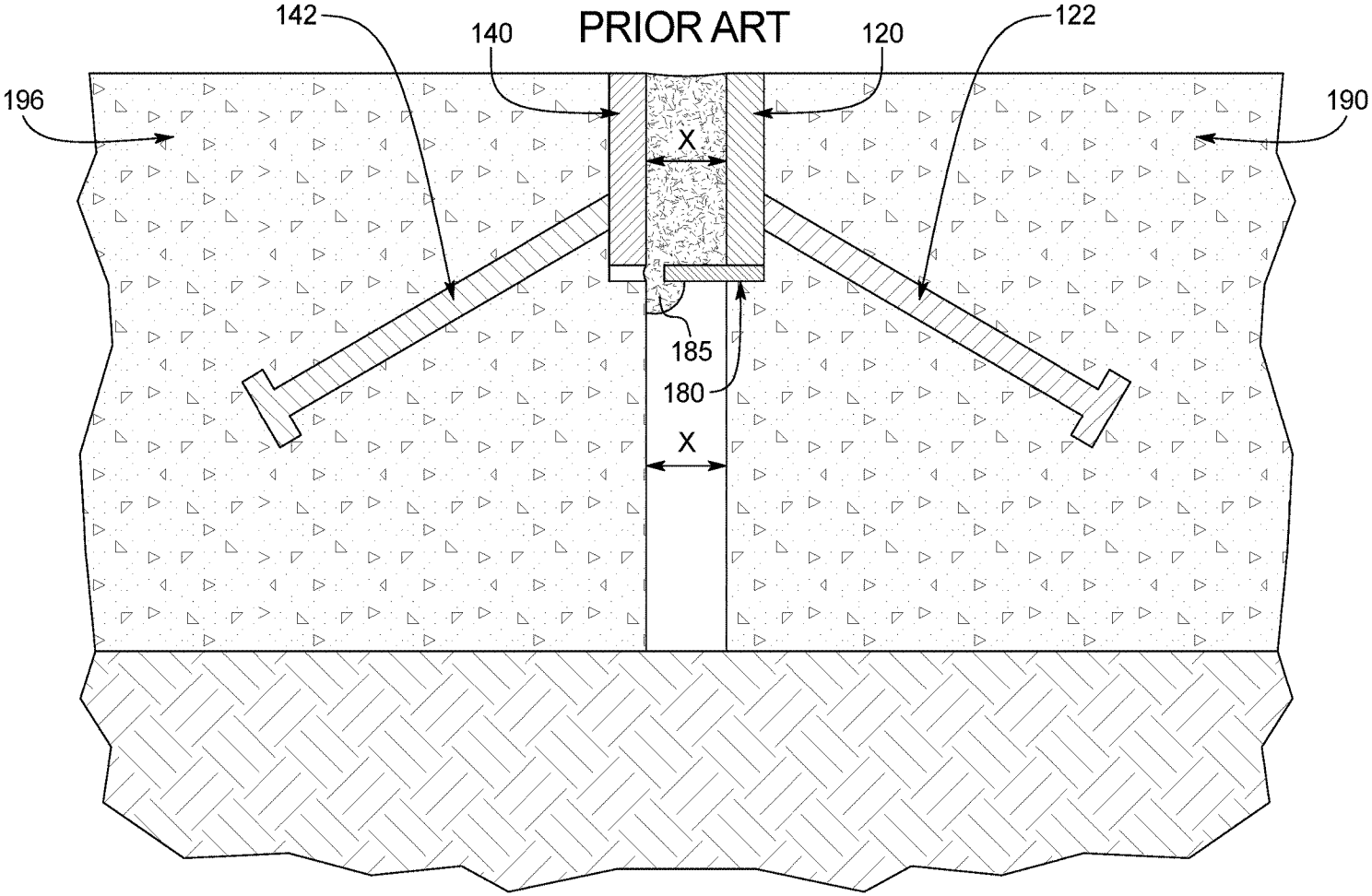
FIG. 7 PRIOR ART
FIG. 7 is a cross-sectional view of the known joint edge assembly of FIG. 5 shown mounted to two concrete slabs, and illustrating the further separation of the two concrete slabs after they have further shrunk to a greater extent than that shown in FIG. 6.

Referring now to FIGS. 8A, 8B, 8C, 9A, 9B, 10, and 11, one example embodiment of the present disclosure includes a joint edge assembly generally indicated by numeral 500, a reusable multiple position height adjuster generally indicated by numeral 700, and a reusable base generally indicated by numeral 900.

The joint edge assembly 500 generally includes: (1) an elongated longitudinal joint rail having a first elongated joint edge member 520 and a second elongated joint edge member 540; (2) a plurality of connectors 555 which connect the first and second elongated joint edge members 520 and 540 along their lengths during installation; (3) a first plurality or set of anchors 522 integrally connected to and extending outwardly and downwardly from the first elongated joint edge member 520; (4) a second plurality or set of anchors 542 integrally connected to and extending outwardly and downwardly from the second elongated joint edge member 540; and (5) an attachment plate or attacher 560 having an elongated body and integrally connected to and extending downwardly from the first elongated joint edge member 520.

More specifically, the first elongated joint edge member 520 in this illustrated example embodiment includes an elongated body have an upper edge 521, a lower edge 523, a slab engagement side 524, a joint member engagement side 525, a first end edge 526, and a second end edge 527. Likewise, the second elongated joint edge member 540 in this illustrated example embodiment includes an elongated body have an upper edge 541, a lower edge 543, a slab engagement side 544, a joint member engagement side 545, a first end edge 546, and a second end edge 547.

The elongated joint edge members 520 and 540 are each made from steel in this illustrated example embodiment. It should be appreciated that the elongated joint edge members can be made from other suitable materials in accordance with the present disclosure. It should also be appreciated that the elongated joint edge members can be made having other suitable shapes and sizes in accordance with the present disclosure.

The connectors 555 connect the first and second elongated joint edge members 520 and 540 along their lengths during installation. The connectors 555 are respectively extendable though holes drilled or otherwise formed in the elongated joint edge members at longitudinal intervals. In one embodiment, the connectors fit within the holes via an interference fit, and particularly are of a slightly larger diameter than the holes such that they fit in the holes is substantially tight manner. This substantially tight fit eliminates play in the two joint edge members 520 and 540. The connectors 555 are configured to enable the elongated joint edge members to self-release under the force of the concrete slabs 590 and 596 shrinking during hardening.

The connectors are made from a plastic such as nylon in this illustrated example embodiment. It should be appreciated that the connectors can be made from other suitable materials and in other suitable manners in accordance with the present disclosure. The material of the connectors can be suitably chosen according to the design tensile strength of the concrete such that the connectors yield under the shrinkage stress of the concrete slabs 590 and 596. The tensile strength can also be variable according to the conditions and application of the concrete slabs. As the concrete slabs 590 and 596 shrink, the anchors 522 and 542, which are respectively embedded in the concrete slabs 590 and 596, pull the elongated joint edge members 520 and 540 apart. It should also be appreciated that the connectors can be made having other suitable shapes and sizes in accordance with the present disclosure. It should further be appreciated that the quantity and/or positioning of connectors can vary in accordance with the present disclosure. It should further be appreciated that in various embodiments, the joint edge assembly does not include such connectors in accordance with the present disclosure but rather includes another suitable mechanism for maintaining the first and second elongated joint edge members together during installation.

The first plurality or set of anchors 522 are integrally connected to and extend outwardly and downwardly from the slab engaging side 524 of the first elongated joint edge member 520. After the first elongated joint edge member 520 is installed, each anchor 522 extends into the region where the concrete of the first slab 590 is to be poured such that, upon hardening of the first concrete slab 590, the anchors 522 are cast within the body of the first concrete slab 590. The anchors 522 are made from steel and welded to the slab engagement side 524 of the first elongated joint edge member 520 in this illustrated example embodiment. It should be appreciated that the anchors 522 can be made from other suitable materials and attached to the elongated joint edge member 520 in other suitable manners in accordance with the present disclosure. It should also be appreciated that the anchors can be made having other suitable shapes and sizes in accordance with the present disclosure. It should further be appreciated that the quantity and/or positioning of anchors can vary in accordance with the present disclosure.

The second plurality or set of anchors 542 are integrally connected to and extend outwardly and downwardly from the slab engaging side 544 of the second elongated joint edge member 540. After the second elongated joint edge member 540 is installed, each anchor 542 extends into the region where the concrete of the second slab 596 is to be poured such that, upon hardening of the second concrete slab 596, the anchors 542 are cast within the body of the second concrete slab 596. The anchors 542 are made from steel and welded to the slab engagement side 544 of the second elongated joint edge member 540 in this illustrated example embodiment. It should be appreciated that the anchors can be made from other suitable materials and attached to the elongated joint edge member in other suitable manners in accordance with the present disclosure. It should also be appreciated that the anchors can be made having other suitable shapes in accordance with the present disclosure. It should further be appreciated that the quantity and/or positioning of anchors can vary in accordance with the present disclosure.

The attachment plate or attacher 560 includes an elongated body 570. The elongated body 570 in this illustrated example embodiment includes an elongated vertically or substantially vertically extending body have an upper edge or surface 571, a lower edge or surface 572, a first slab engagement side or surface 573, a first joint member engagement side surface 574, a first end edge or surface 575, and a second end edge or surface 576. The attacher 560 includes or defines sets of adjuster attachment holes 580 that facilitate attachment to the adjusters 700. The attacher 560 also includes or defines sets of pocket attachment holes 590 that facilitate attachment of the pockets 600 to the attacher 560.

The attachment plate or attacher 560 is made from steel in this illustrated example embodiment. It should be appreciated that the attacher can be made from other suitable materials in accordance with the present disclosure. It should also be appreciated that the attacher can be made having other suitable shapes in accordance with the present disclosure. In the illustrated embodiment, the attacher 560 is welded to the first joint member 520 such that the upper portion of the first joint member engagement side surface 574 engages the lower portion of the slab engagement side 524 of the first elongated joint edge member 520.

The attachment plate or attacher 560 serves several purposes. The attacher 560 assists in the positioning of the remainder of the joint assembly 500 at installation and provides for placement of the pockets or block out sheaths 600. The pockets or block out sheaths 600 receive the dowels or load transfer plates 610, which are used for transferring loads between the first concrete slab 590 and the second concrete slab 596. In this illustrated example embodiment, each load transfer plate 610 includes a substantially tapered end having substantially planar upper and lower surfaces adapted to be cast in the second concrete slab 596. The load transfer plate 610 is configured to transfer, between the first and second slabs 590 and 596, a load directed substantially perpendicular to the intended upper surface of the first slab 590. The width of the pocket 600 is greater than the width of the substantially tapered end at each corresponding depth along the substantially tapered end and the block out sheath, such that the substantially tapered end can slide within the pocket in a direction parallel to the intersection between the upper surface of the first slab 590 and the joint surface. The load transfer plate 610 is secured in the second slab 596 and movable relative to the first slab 590 such that the load transfer plate 610 and pocket 600 are adapted to transfer a load between the first and second concrete slabs 590 and 596. The purpose and use of these pockets 600 and load transfer plates 610 are described in much greater detail in U.S. Pat. No. 6,354,760, the contents of which are incorporated herein by reference.

It should be appreciated that the attachment plate or attacher 560 of the present disclosure substantially eliminates the need for formwork that would support the pockets or block out sheaths 600 during the installation or pouring of the first concrete slab 590.

The reusable multiple position height adjuster 700 and reusable base 900 of the present disclosure are configured to be used in the installation of the joint edge assembly 500 with respect first and second concrete slabs 590 and 596 in accordance with various methods of the present disclosure as further discussed below. The joint member multi-position height adjuster 700 includes: (a) a first leg 710 of a first height; (b) a first foot 720 connected to the first leg 710; (c) a first toe 730 connected to the first foot 720; (d) a second leg 750 having a second different greater height and connected to the first leg 710; (e) a second foot 760 connected to the second leg 750; (f) a second toe 770 connected to the second foot 760; (g) a stabilizing body or stabilizer 780 connected to the first leg 710, the first foot 720, the second leg 750, and the second foot 760.

In this illustrated example embodiment, each height adjuster 700 is reusable and is made or molded from a suitable plastic; however, it should be appreciated that each height adjuster could be made from other suitable materials. It should also be appreciated that the legs, feet, and toes can be made with any suitable dimensions and with other suitable configurations. In one example embodiment, the height of the first leg 710 is approximately 3 inches and the height of the second leg 750 is approximately 4 inches.

Figure 8A:
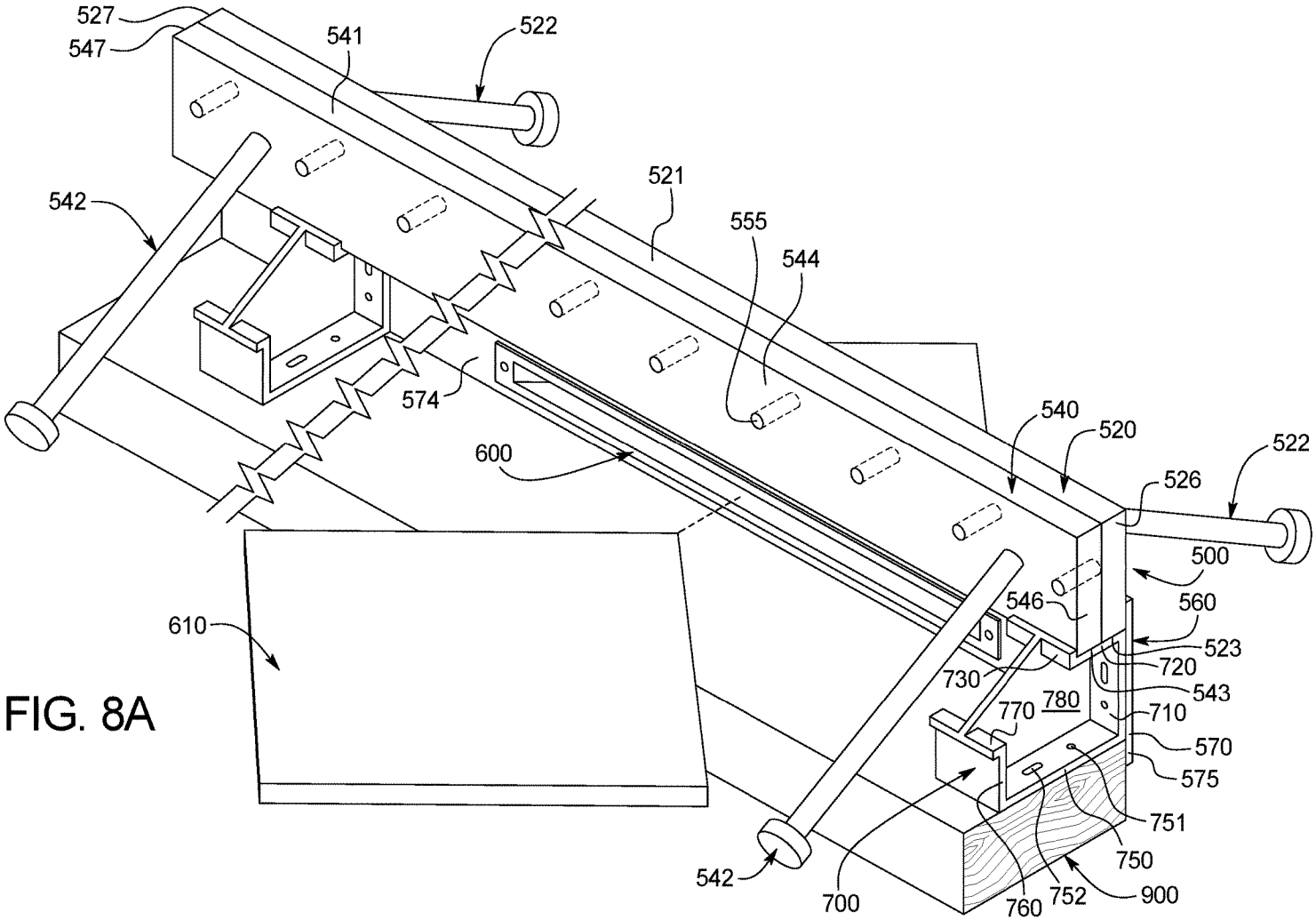
FIG. 8A is a first side top perspective view of one example embodiment of the joint edge assembly, the reusable multiple position height adjuster, and the reusable base of the present disclosure, and illustrating the formwork in a first position.
Figure 8B:
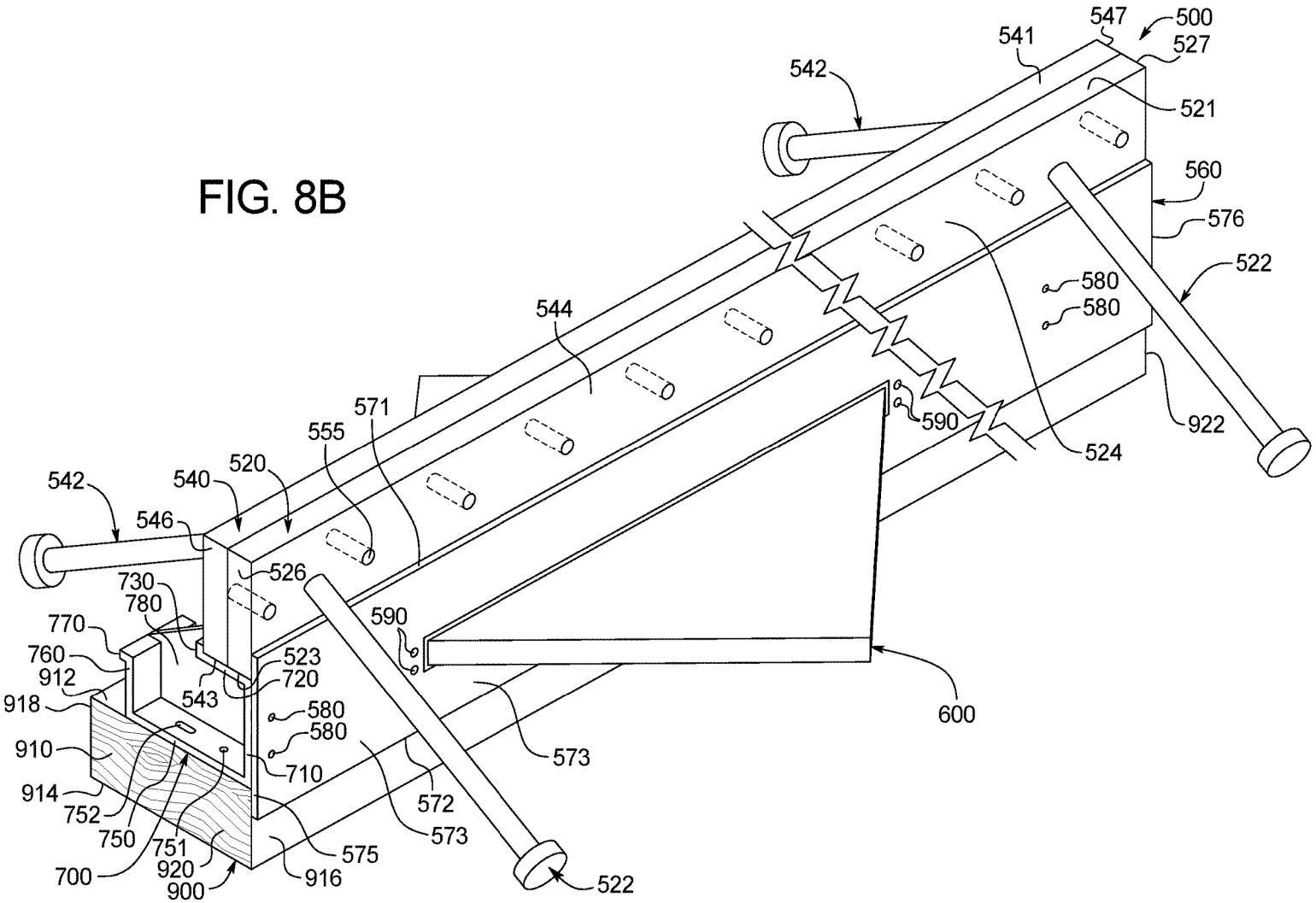
FIG. 8B is a second side top perspective view of the joint edge assembly, the reusable multiple position height adjuster, and the reusable base of FIG. 8A, and illustrating the formwork in the first position.
Figure 8C:
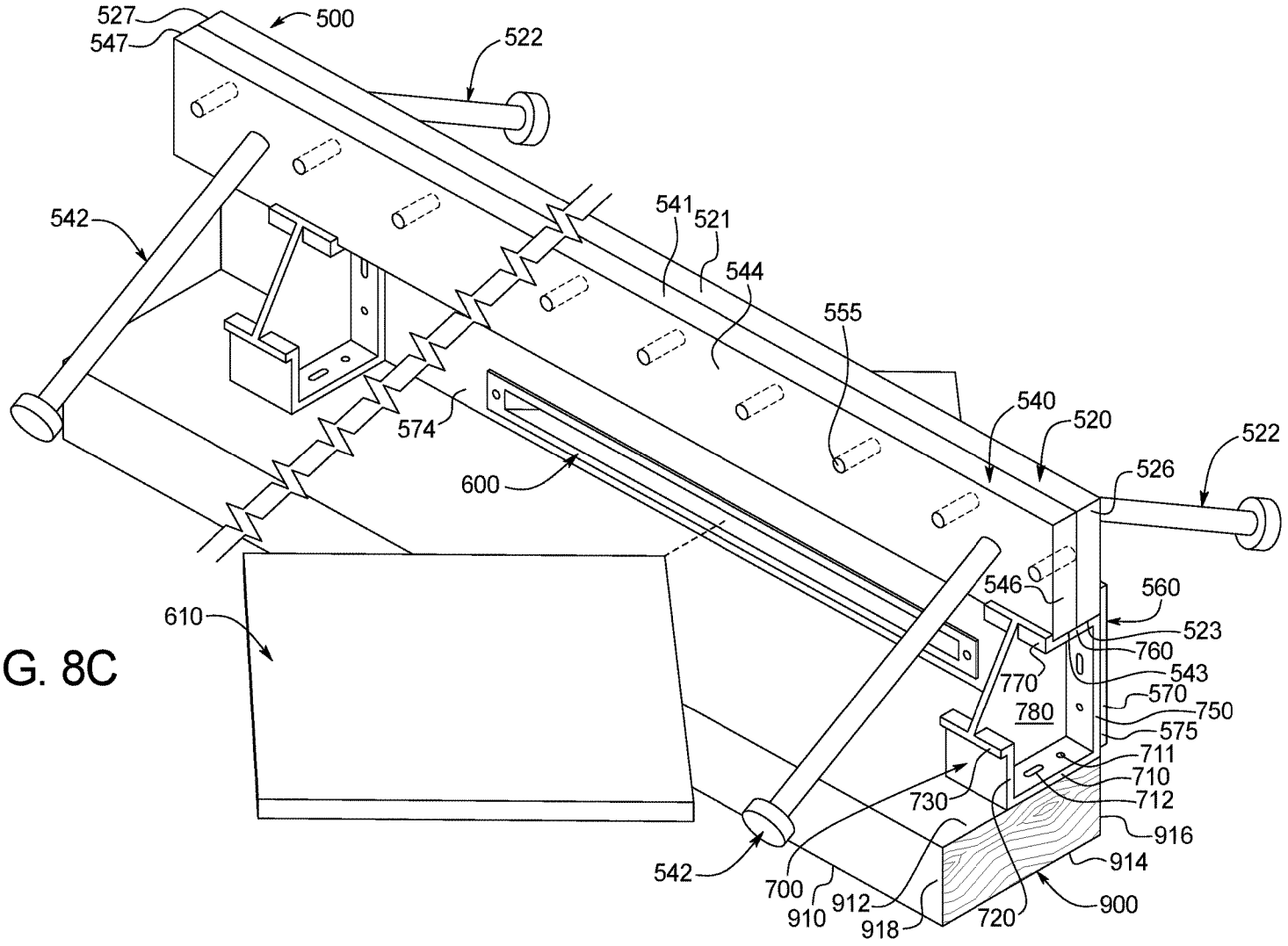
FIG. 8C is a first side top perspective view of the joint edge assembly and formwork of FIG. 8A, and illustrating the reusable multiple position height adjuster in a second different position.
Figure 9A:
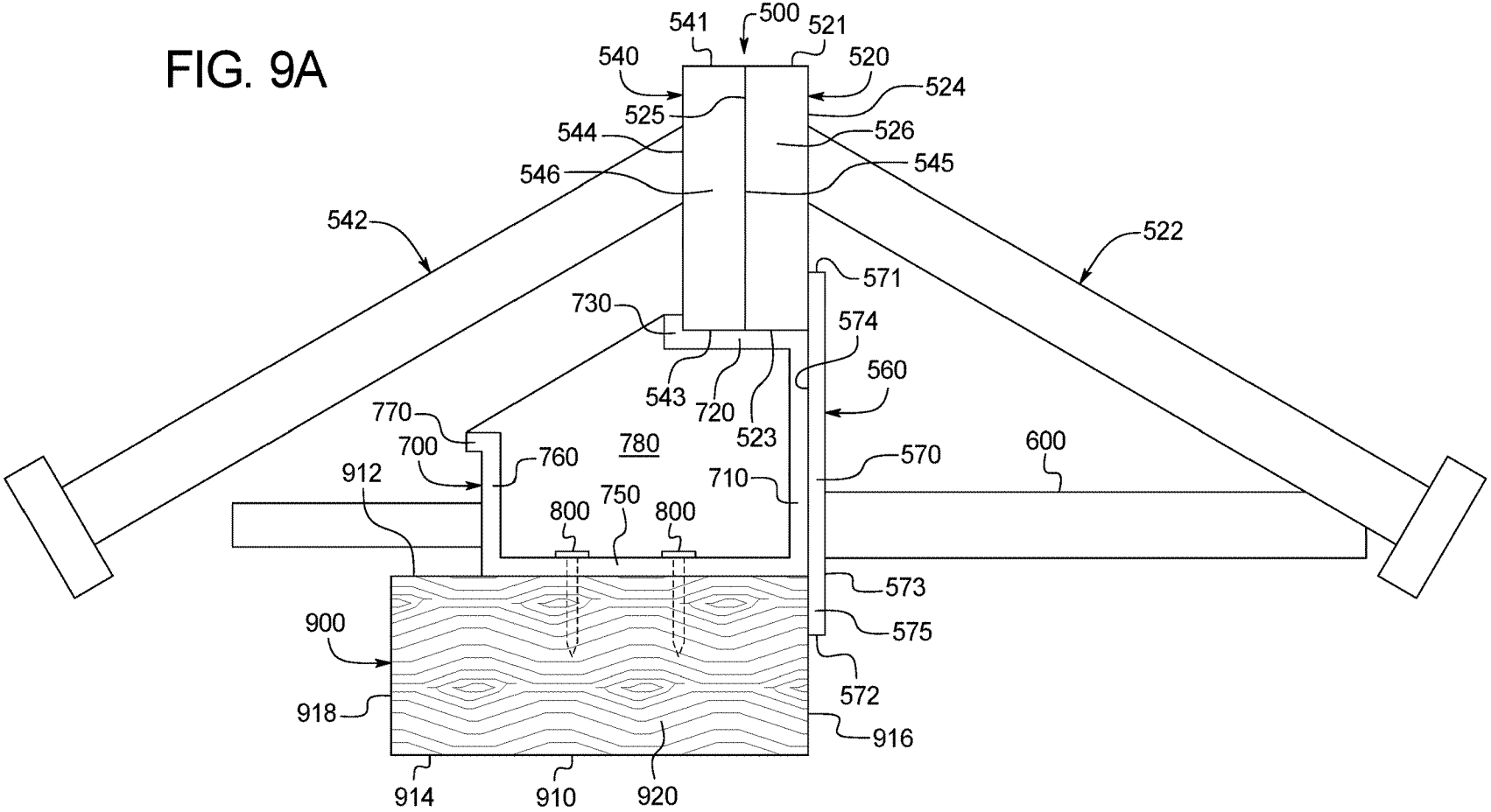
FIG. 9A is an end view of the joint edge assembly and formwork of FIG. 8A, and illustrating the reusable multiple position height adjuster in the first position.
Figure 9B:
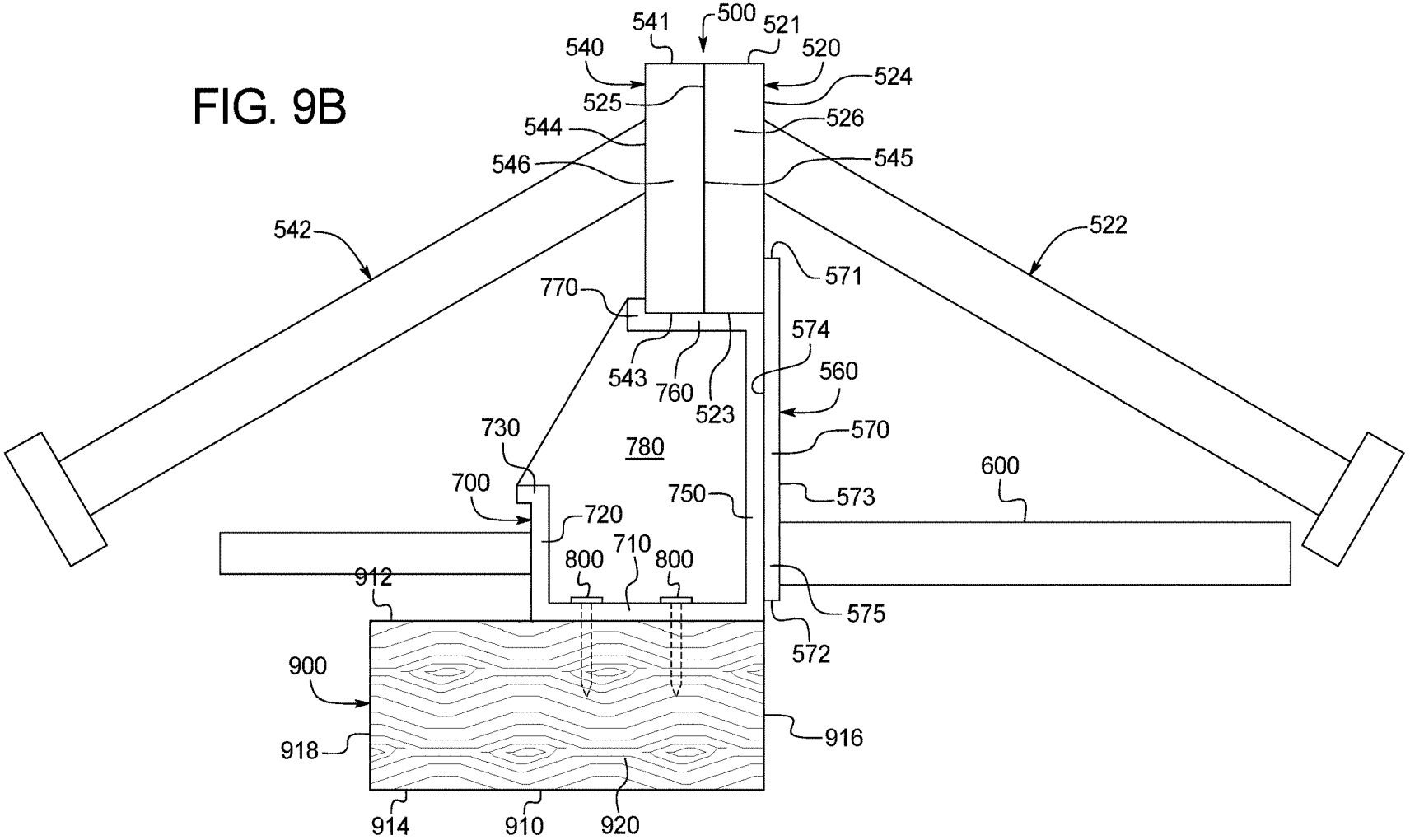
FIG. 9B is an end view of the joint edge assembly and formwork of FIG. 8A, and illustrating the reusable multiple position height adjuster in the second different position.

The illustrated height adjuster 700 is configured to be used in two different positions. FIGS. 8A, 8B, and 9A show the first position, and FIGS. 8C and 9B show the second different position. The first position shown in FIGS. 8A, 8B, and 9A is used when the joint assembly 500 is to be positioned at a generally relatively lower position with respect to the base 900. The second position shown in FIGS. 8C and 9B is used when the joint assembly 500 is to be positioned at a generally relatively higher position with respect to the base 900. The different positions thus account for different concrete slab thicknesses.

In the first position shown in FIGS. 8A, 8B, and 9A, (a) the first leg 710 extends vertically (or substantially vertically) adjacent to the attacher 560, (b) the first foot 720 extends horizontally (or substantially horizontally) and supports the bottom edges 523 and 543 of the joint members 520 and 540, and the (c) first toe 730 extends vertically (or substantially vertically) adjacent to the second slab engaging surface 544 of the joint member 540 for secure engagement and support of the joint members 520 and 540. In this first position, the second leg 750 extends horizontally (or substantially horizontally), rests on the base 900, and is secured to the base 900 by fasteners such as nails 800 during use. It should be appreciated that the second leg 750 defines suitable fastener openings 751 and 752.

In the second position shown in FIGS. 8C and 9B, (a) the second leg 750 extends vertically (or substantially vertically) adjacent to the attacher 560, (b) the second foot 760 extends horizontally (or substantially horizontally) and supports the bottom edges 523 and 543 of the joint members 520 and 540, and (c) the second toe 770 extends vertically (or substantially vertically) adjacent to the second slab engaging surface 544 of the joint member 540 for secure engagement and support of the joint members 520 and 540. In this second position, the first leg 710 extends horizontally (or substantially horizontally), rests on the base 900, and is secured to the base 900 by fasteners such as nails 800. It should be appreciated that the first leg 710 also defines suitable fastener openings 711 and 712 for attachment to the base 900 during use.

In this illustrated example embodiment, the base 900 includes a solid elongated body 910 having a top surface 912, a bottom surface 914, a first or inner side surface 916, a second or outer side surface 918, a first end 920, and a second end 922.

In this illustrated example embodiment, the reusable base is made from a suitable wood; however, it should be appreciated that the base could be made from other suitable materials. It should also be appreciated that the base can be made with any suitable dimensions and with other suitable configurations. It should also be appreciated that the base can be formed in several sections.

It should also be appreciated that multiple spaced apart height adjusters 700 are employed with one joint member assembly as shown in FIGS. 8A, 8B, 8C, 9A, 9B, and 10. It should be further appreciated that in alternative embodiments the height adjuster 700 may be elongated such that a smaller quantity of height adjusters (such as one height adjuster) can be used.

Figure 10:
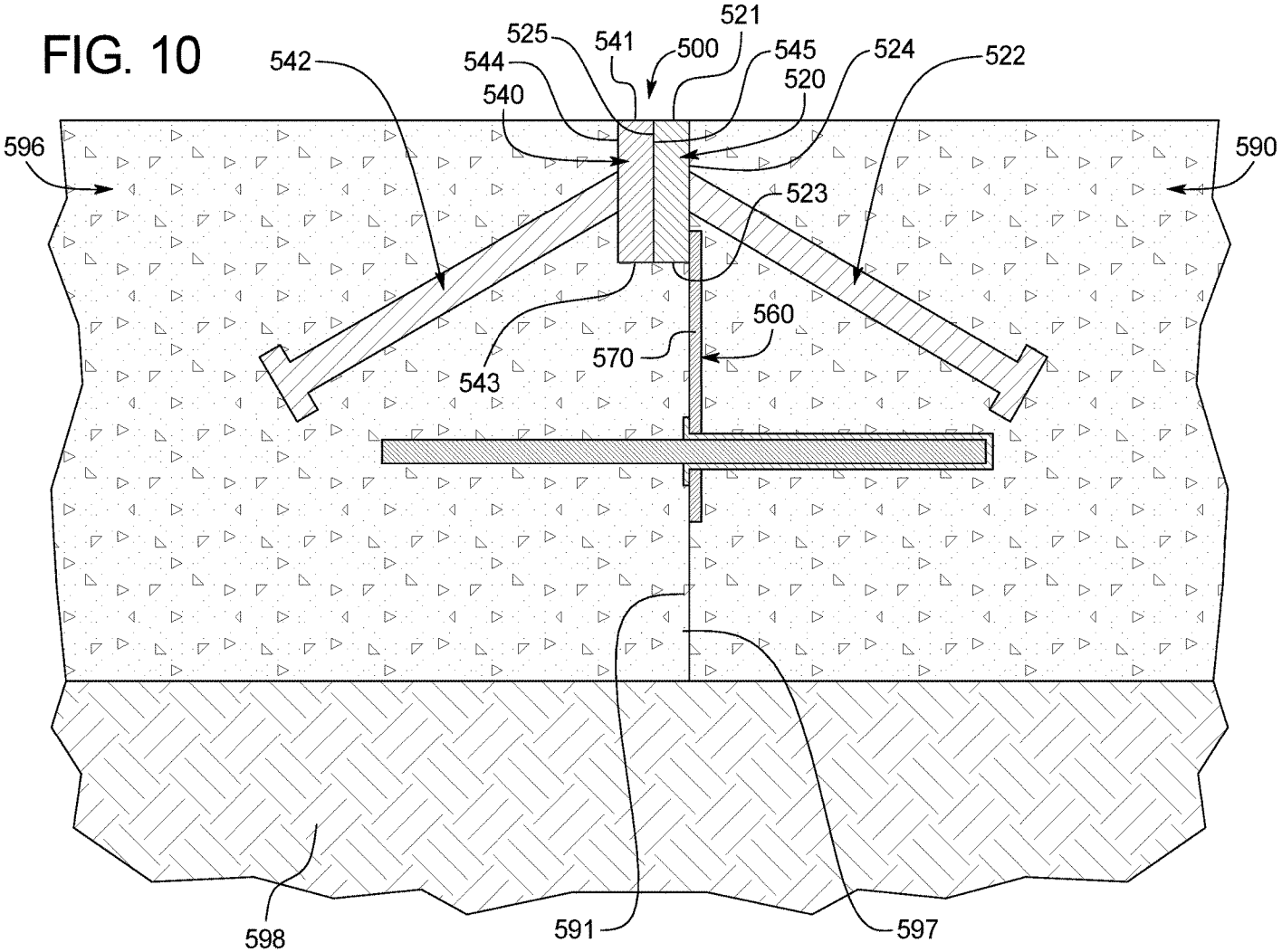
FIG. 10 is a cross-sectional view of the joint edge assembly of FIG. 8A shown mounted to two concrete slabs after installation, and showing the position of the joint edge assembly relative to the plane of the joint and the ends or edges of the adjacent concrete slabs.
Figure 11:
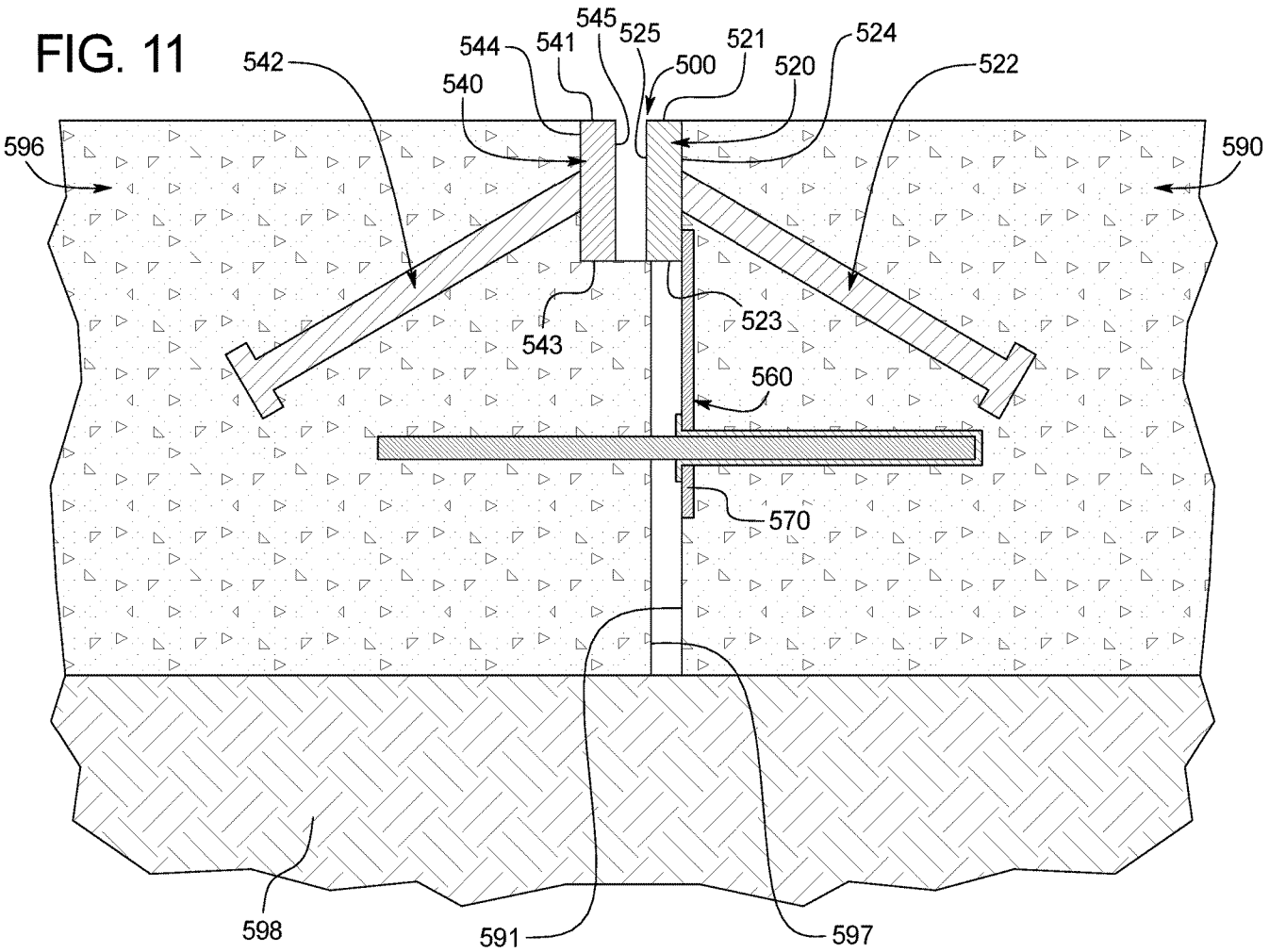
FIG. 11 is a partial cross-sectional view of the joint edge assembly of FIG. 8A shown mounted to two concrete slabs after installation, and showing the position of the joint edge assembly relative to the concrete slabs and the separation of the two concrete slabs after they have shrunk to a substantial extent.

As indicated by FIGS. 8A, 8B, 8C, 9A, 9B, 10, and 11, the method of the present disclosure includes positioning the joint edge assembly 510 where the joint will be formed before either of the two adjacent concrete slabs 590 and 596 are poured. The reusable multiple position height adjuster 700 and reusable base 900 are used to position the elongated joint edge members 520 and 540 and the attacher 560 such that the joint edge members 520 and 540 are oriented in an offset position along the length of the joint between the adjacent concrete slab sections 590 and 596 as generally shown in FIGS. 10 and 11, and parallel to the ground surface 598 that defines a generally flat reference plane.

More specifically, the height adjuster 700 and base 900 are configured to support the joint assembly 500 and to align the slab engagement surface 524 of the joint edge member 520 adjacent to the vertically extending plane in which the vertically extending side or end surface 591 of the first concrete slab 590 will lie (after the first concrete slab 590 is poured as best shown in FIGS. 10 and 11). The reusable multiple position height adjuster 700 and reusable base 900 are also configured to support the joint assembly 500 such that the opposite or second slab facing side 525 of the first joint edge member 520 extends in a second vertical or substantially vertical plane inwardly (relative to the second concrete slab 596) of the vertical plane in which the vertically extending side or end surface 597 of the second concrete slab 596 will lie after the second concrete slab 596 is poured. The height adjuster 700 and base 900 are also configured to support the joint assembly 500 such that the first slab facing side 545 of the second joint edge member 540 extends in a third vertical or substantially vertical plane further inwardly (relative to the second concrete slab 596) of the vertical plane in which the vertically extending side or end surface 597 of the second concrete slab 596 will lie after the second concrete slab 596 is poured. The reusable multiple position height adjuster 700 and reusable base 900 are also configured to support the joint assembly 500 such that the slab engagement surface 544 of the second joint edge member 540 extends in a vertical or substantially vertical plane even further inwardly (relative to the second concrete slab 596) of the vertical plane in which the vertically extending side or end surface 597 of the second concrete slab 596 will lie after the second concrete slab 596 is poured. The height adjuster 700 and base 900 are also configured to support the joint assembly 500 such that the slab engagement surface 573 of the attacher 560 extends in a first vertical or substantially vertical plane inwardly (relative to the first concrete slab 590) of the vertical plane in which the vertically extending side or end surface 591 of the first concrete slab 590 will lie after the first concrete slab 590 is poured. The height adjuster 700 and base 900 are also configured to support the joint assembly 500 such that the opposite or second slab facing side 574 of the attacher 560 extends in a second vertical or substantially vertical plane aligned with the vertical plane in which the vertically extending side or end surface 591 of the first concrete slab 590 will lie after the first concrete slab 590 is poured.

The attacher 560 is configured to hold the pockets or block out sheaths 600 such that pockets or block out sheaths 600 extend into the first concrete slab 590 after the first concrete slab 590 is poured. The attacher 560 is configured to enable the positioning of load transfer members or dowels 610 in the pockets 600 before the second concrete slab 596 is poured and such that part of the load transfer members or dowels 610 in the pockets 600 extend into the areas in which the second concrete slab 596 will be poured. This enables the load transfer members or dowels 610 to be cast in the second concrete slab 596 and to move in or relative to the pockets or block out sheaths 600 after the second concrete slab 596 cures.

After the joint edge assembly 510 is properly secured and aligned using the height adjuster 700 and base 900, the first concrete slab 590 is poured. The anchors 522 extending from the elongated joint edge member 520 become embedded in the wet concrete, and provide a positive mechanical connection between the concrete slab 590 and the elongated joint edge member 520.

After the concrete slab 590 has hardened sufficiently, the height adjuster 700 and base 900 are removed and can be reused. After the reusable multiple position height adjuster 700 and reusable base 900 are removed, the connectors 555 hold the elongated joint edge member 540 to the elongated joint edge member 520. The adjacent or second concrete slab 596 is poured and finished such that the anchors 542 extending from the elongated joint edge member 540 become embedded in the wet concrete of the adjacent concrete slab 596.

In this illustrated embodiment, the slab engagement surface 544 of the second joint edge member 540 is positioned inwardly (with respect to the second slab 596) relative to the vertically extending plane in which the vertically extending side or end surface 597 of the second concrete slab 596 will lie as best shown in FIG. 10. In this embodiment, the surface 545 of the second joint edge member 540 is also positioned inwardly (with respect to the second slab 596) relative to the vertically extending plane in which the vertically extending side or end surface 597 of the second concrete slab 596 will lie as best shown in FIG. 10. The method of the present disclosure thus positions the joint edge assembly such that, after the concrete of the first slab is poured but before the concrete hardens, the joint member engagement sides of the joint edge members are offset from the joint (as opposed to aligned with the joint as in the prior known joint assemblies shown in FIGS. 1, 2, 3, 4, 5, 6, and 7).

As the chemical reaction between the cement and the water in the adjacent concrete slabs 590 and 596 occurs (i.e., hydration), the concrete hardens and shrinks. This causes the concrete slabs 590 and 596 to separate from one another, and the self-release connectors 555 enable the elongated joint edge members 520 and 540 to also separate from one another as generally shown in FIG. 11. It should be appreciated that the connectors 555 remain throughout the concrete pouring operation and include release elements that enable the elongated joint edge members 520 and 540 to release from each other under the force of the concrete slabs 590 and 596 shrinking during hardening, thus enabling the joint to open.

It should be appreciated from the above that various embodiments of the method of the present disclosure include using the height adjuster 700 and the base 900 to position the joint edge assembly 500 where the joint will be formed before either of the two adjacent concrete slabs are poured. More specifically, various embodiments of the method of the present disclosure include the following steps: (1) positioning the base 900 on the surface or substrate 598; (2) positioning each height adjuster 700 on the base 900 in one of the two different positions or heights depending of the desired height of the joint edge assembly 520; and (3) attaching each height adjuster 700 to the base 900 with a plurality of fasteners (such as fasteners 800, all such that the elongated joint edge members 520 and 540 will be positioned along or adjacent to the length of the joint between the adjacent concrete slab sections as described above and below.

Various embodiments of the method of the present disclosure include the following further step of positioning the elongated joint edge members 520 and 540 such that: (a) the slab engagement surface 524 of the first joint edge member 520 extends in a first vertical or substantially vertical plane directly adjacent to the vertically extending plane in which the vertically extending side or end surface 591 of the first concrete slab 590 will lie such that the slab engagement surface 524 of the first joint edge member 520 will engage the vertically extending side or end surface of the first concrete slab 590 after the first concrete slab 590 is poured; (b) the opposite or second slab facing side 525 of the first joint edge member 520 extends in a second vertical or substantially vertical plane inwardly (relative to the second concrete slab 596) of the vertical plane in which the vertically extending side or end surface 597 of the second concrete slab 596 will lie after the second concrete slab 596 is poured; (c) the first slab facing side 545 of the second joint edge member 540 extends in a third vertical or substantially vertical plane further inwardly (relative to the second concrete slab 596) of the vertical plane in which the vertically extending side or end surface 597 of the second concrete slab 596 will lie after the second concrete slab 596 is poured; (d) the slab engagement surface 544 of the second joint edge member 540 extends in a vertical or substantially vertical plane even further inwardly (relative to the second concrete slab 596) of the vertical plane in which the vertically extending side or end surface 597 of the second concrete slab 596 will lie after the second concrete slab 596 is poured; (e) the slab engagement surface 573 of the attacher 560 extends in a first vertical or substantially vertical plane inwardly (relative to the first concrete slab 590) of the vertical plane in which the vertically extending side or end surface 591 of the first concrete slab 590 will lie after the first concrete slab 590 is poured; and (f) the opposite or second slab facing side 574 of the attacher 560 extends in a second vertical or substantially vertical plane aligned with the vertical plane in which the vertically extending side or end surface 591 of the first concrete slab 596 will lie after the first concrete slab 590 is poured.

The method of the present disclosure further includes positioning pockets or block out sheaths 600 in the attacher 560 such that pockets or block out sheaths 600 extend into the end the first concrete slab 590 after the first concrete slab 590 is poured. The method of the present disclosure further includes positioning load transfer members or dowels 610 in the pockets 600 before the second concrete slab 596 is poured to and such that part of the load transfer members or dowels 610 in the pockets 600 extend into the areas in which the second concrete slab 596 will be poured. This enables the load transfer members or dowels 610 to be cast in the second concrete slab 596 and to move in or relative to the pockets or block out sheaths 600 after the second concrete slab 596 cures.

The method of the present disclosure further includes removing the base 900 and the height adjuster 700 after the first concrete slab 590 at least partially cures and before the second concrete slab 596 is poured.

It should be appreciated from the above that various embodiments of the method of the present disclosure further positioning the height adjuster 700 in one of the two different positions based on the desired height of joint assembly 500.

Figure 12:
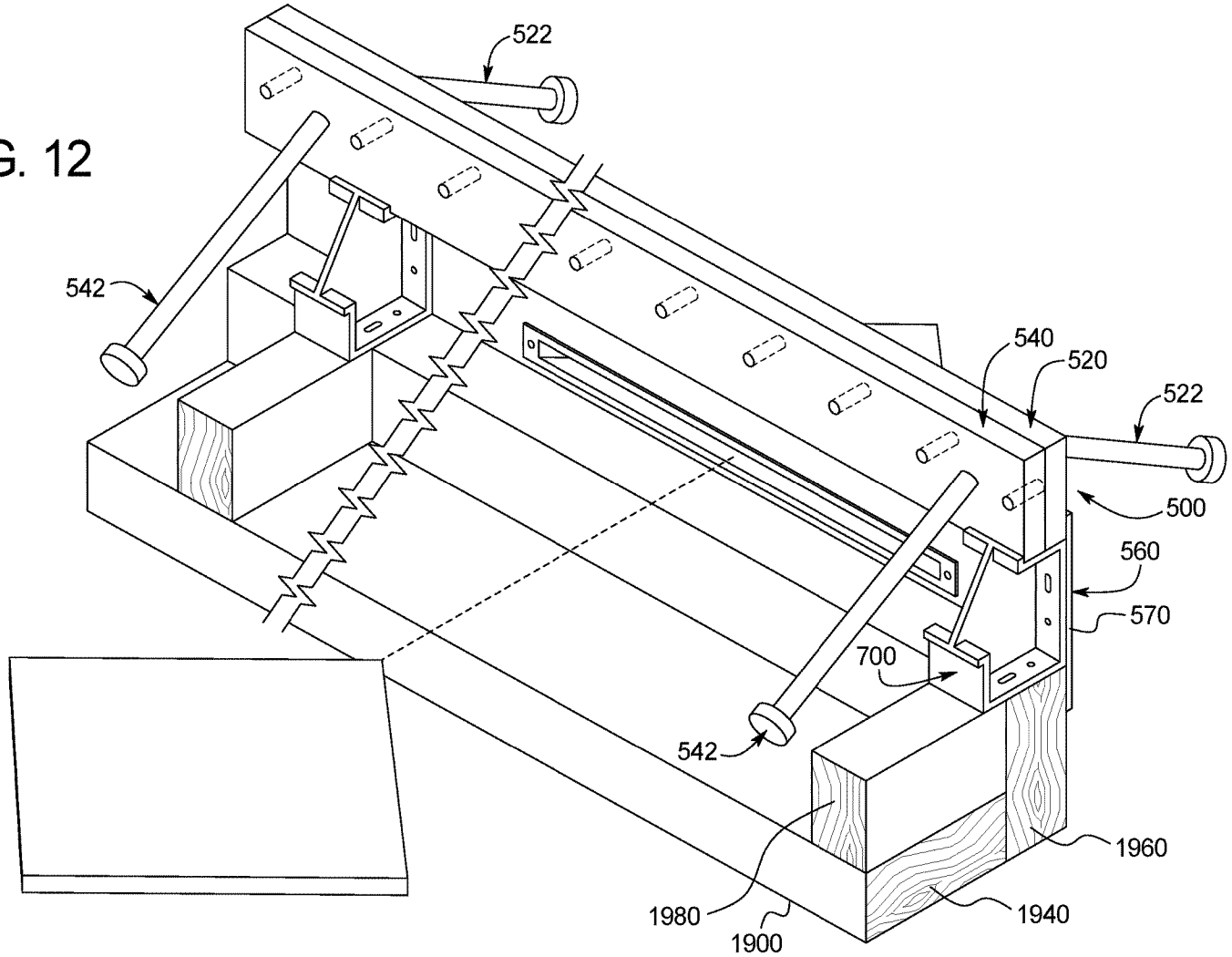
FIG. 12 is a first side top perspective view of the joint edge assembly of FIG. 8A and an alternative example embodiment of the reusable base of the present disclosure, and illustrating the reusable multiple position height adjuster in a first position.
Figure 13:
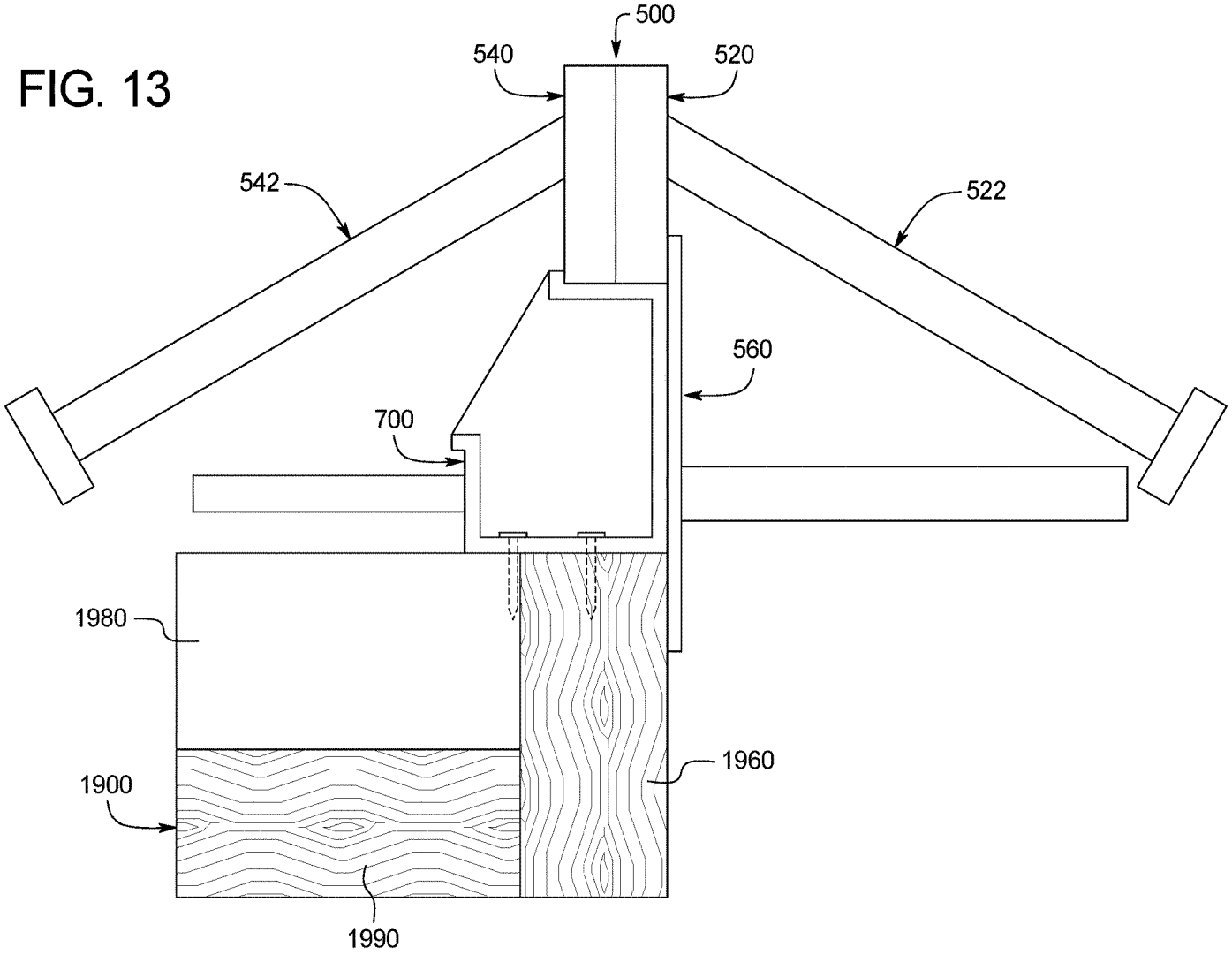
FIG. 13 is an end view of the joint edge assembly of FIG. 8A and the reusable base of FIG. 12, and illustrating the reusable multiple position height adjuster in the first position.

Referring now to FIGS. 12 and 13, another example embodiment of the formwork of the present disclosure is generally indicated by numerals 700 and 1900. In this alternative embodiment, the reusable multiple position height adjuster 700 is the same, but the reusable base 1900 is different. In this illustrated embodiment, the base 1900 includes an elongated horizontally extending bottom section 1940, an elongated vertically extending first wall engaging section 1960, and adjuster supporting sections 1980. The adjuster supporting sections 1980 are each configured to support the height adjusters 700 as generally shown in FIGS. 12 and 13.

It should be appreciated that the arrangement of FIGS. 8A to 13 could be reversed such that the attachment plate or attacher 560 is attached to the joint member 540 instead of the joint member 520.

It should be appreciated from the above, that in various embodiments, the present disclosure includes a method of forming a joint between a first concrete slab and a second concrete slab, said method comprising: (a) positioning a reusable base on a substrate; (b) positioning a reusable multiple position height adjuster on the base, wherein positioning the reusable multiple position height adjuster on the base includes positioning the reusable multiple height adjuster on the base in one of the two different positions depending of the desired height of the joint edge assembly; (c) attaching the reusable multiple position height adjuster to the base; (d) positioning first and second elongated joint edge members on the reusable multiple position height adjuster; and (e) removing the base and the height adjuster after the first concrete slab at least partially cures and before the second concrete slab is poured.

In certain such embodiments, the reusable multiple position height adjuster includes: (a) a first leg of a first height; (b) a first foot connected to the first leg; (c) a second leg having a second greater height than the first leg and connected to the first leg; (d) a second foot connected to the second leg; and (e) a stabilizer connected to the first leg, the first foot, the second leg, and the second foot, wherein the reusable multiple position height adjuster is configured to be positioned in a first position such that the first leg extends vertically or substantially vertically, the first foot extends horizontally or substantially horizontally and supports the elongated joint edge members, and the second leg extends horizontally or substantially horizontally, and wherein the reusable multiple position height adjuster is configured to be positioned in a second position such that the second leg extends vertically or substantially vertically, the second foot extends horizontally or substantially horizontally and supports the elongated joint edge members, and the first leg extends horizontally or substantially horizontally.

In certain such embodiments, the method includes positioning pockets through an attacher connected to one of the elongated joint edge members such that pockets extend into the first concrete slab after the first concrete slab is poured.

In certain such embodiments, the method includes positioning load transfer members in the pockets before the second concrete slab is poured, such that a part of each of the load transfer members extends into the area in which the second concrete slab will be poured, enabling the load transfer members to be cast in the second concrete slab and to move in or relative to the pockets after the second concrete slab cures.

It should also be appreciated from the above, that in various embodiments, the present disclosure includes a method of forming a joint between a first concrete slab and a second concrete slab, said method comprising: (a) positioning a reusable base on a substrate; (b) positioning a reusable height adjuster on the base; (c) attaching the height adjuster to the base; (d) positioning first and second elongated joint edge members on the height adjuster such that: (i) a slab engagement surface of the first joint edge member extends in a first vertical or substantially vertical plane directly adjacent to the substantially vertically extending plane in which the substantially vertically extending end surface of a first concrete slab will lie after the first concrete slab is poured; (ii) a second slab facing side of the first joint edge member extends in a second vertical or substantially vertical plane inwardly, relative to the second concrete slab, of the substantially vertical plane in which the substantially vertically extending end surface of the second concrete slab will lie after the second concrete slab is poured, (iii) a first slab facing side of the second joint edge member extends in a third vertical or substantially vertical plane further inwardly, relative to the second concrete slab, of the substantially vertical plane in which the substantially vertically extending end surface of the second concrete slab will lie after the second concrete slab is poured, (iv) a slab engagement surface of the second joint edge member extends in a vertical or substantially vertical plane even further inwardly, relative to the second concrete slab, of the substantially vertical plane in which the substantially vertically extending end surface of the second concrete slab will lie after the second concrete slab is poured, (v) a slab engagement surface of an attacher attached to the first joint member extends in a first vertical or substantially vertical plane inwardly, relative to the first concrete slab, of the substantially vertical plane in which the substantially vertically extending end surface of the first concrete slab will lie after the first concrete slab is poured, and (vi) a second slab facing side of the attacher extends in a second vertical or substantially vertical plane aligned with the vertical plane in which the substantially vertically extending end surface of the first concrete slab will lie after the first concrete slab is poured; (e) positioning pockets through the attacher such that pockets extend into the first concrete slab after the first concrete slab is poured; (f) positioning load transfer members in the pockets before the second concrete slab is poured, such that a part of each of the load transfer members extends into the area in which the second concrete slab will be poured, enabling the load transfer members to be cast in the second concrete slab and to move in or relative to the pockets after the second concrete slab cures; and (g) removing the base and the height adjuster after the first concrete slab at least partially cures and before the second concrete slab is poured.

In certain such embodiments, the method includes positioning the reusable height adjuster on the base includes positioning the height adjuster on the base in one of the two different positions depending of the desired height of the joint edge assembly.

In certain such embodiments, the method includes securing the reusable height adjuster to the base.

It should also be appreciated from the above, that in various embodiments, the present disclosure provides a reusable multiple position height adjuster for supporting first and second elongated joint members of a joint edge assembly configured to form a joint between two concrete slabs, said reusable multiple position height adjuster comprising: (a) a first leg of a first height; (b) a first foot connected to the first leg; (c) a second leg having a second greater height than the first leg and connected to the first leg; and (d) a second foot connected to the second leg, wherein the first leg, the first foot, the second leg, and the second foot are configured to be positioned in a first position such that the first leg extends vertically or substantially vertically, the first foot extends horizontally or substantially horizontally and supports the first and second elongated joint members, and the second leg extends horizontally or substantially horizontally, and wherein the first leg, the first foot, the second leg, and the second foot are configured to be positioned in a second position such that the second leg extends vertically or substantially vertically, the second foot extends horizontally or substantially horizontally and supports the first and second elongated joint members, and the first leg extends horizontally or substantially horizontally.

In certain such embodiments, the reusable multiple position height adjuster is made from a plastic.

In certain such embodiments, the first leg defines suitable fastener openings.

In certain such embodiments, the second leg defines suitable fastener openings.

In certain such embodiments, the reusable multiple position height adjuster includes a first toe connected to the first foot and a second toe connected to the second foot, wherein when the first leg, the first foot, the second leg, and the second foot are positioned in the first position, the first toe extends vertically or substantially vertically, and wherein when the first leg, the first foot, the second leg, and the second foot are positioned in the second position, the second toe extends vertically or substantially vertically.

It should also be appreciated from the above, that in various embodiments, the present disclosure provides a reusable multiple position height adjuster for supporting first and second elongated joint members of a joint edge assembly configured to form a joint between two concrete slabs, said reusable multiple position height adjuster comprising: (a) a first leg of a first height; (b) a first foot connected to the first leg; (c) a second leg having a second greater height than the first leg and connected to the first leg; (d) a second foot connected to the second leg; and (e) a stabilizer connected to the first leg, the first foot, the second leg, and the second foot, wherein the first leg, the first foot, the second leg, and the second foot are configured to be positioned in a first position such that the first leg extends vertically or substantially vertically, the first foot extends horizontally or substantially horizontally and supports the first and second elongated joint members, and the second leg extends horizontally or substantially horizontally, and wherein the first leg, the first foot, the second leg, and the second foot are configured to be positioned in a second position such that the second leg extends vertically or substantially vertically, the second foot extends horizontally or substantially horizontally and supports the first and second elongated joint members, and the first leg extends horizontally or substantially horizontally.

In certain such embodiments, the reusable multiple position height adjuster is made from a plastic.

In certain such embodiments, the first leg defines suitable fastener openings.

In certain such embodiments, the second leg defines suitable fastener openings.

In certain such embodiments, the reusable multiple position height adjuster includes a first toe connected to the first foot and a second toe connected to the second foot, wherein when the first leg, the first foot, the second leg, and the second foot are positioned in the first position, the first toe extends vertically or substantially vertically, and wherein when the first leg, the first foot, the second leg, and the second foot are positioned in the second position, the second toe extends vertically or substantially vertically.

It should also be appreciated from the above, that in various embodiments, the present disclosure includes a reusable multiple position height adjuster for supporting first and second elongated joint members of a joint edge assembly configured to form a joint between two concrete slabs, said reusable multiple position height adjuster comprising: (a) a first leg of a first height, the first leg defining suitable fastener openings; (b) a first foot connected to the first leg; (c) a first toe connected to the first foot; (d) a second leg having a second greater height than the first leg and connected to the first leg, the second leg defining suitable fastener openings; (e) a second foot connected to the second leg; and (f) a second toe connected to the first foot; wherein the first leg, the first foot, the second leg, and the second foot are configured to be positioned in a first position such that the first leg extends vertically or substantially vertically, the first foot extends horizontally or substantially horizontally and supports the first and second elongated joint members, and the second leg extends horizontally or substantially horizontally, and wherein the first leg, the first foot, the second leg, and the second foot are configured to be positioned in a second position such that the second leg extends vertically or substantially vertically, the second foot extends horizontally or substantially horizontally and supports the first and second elongated joint members, and the first leg extends horizontally or substantially horizontally.

In certain such embodiments, the reusable multiple position height adjuster is made from a plastic.

In certain such embodiments, the reusable multiple position height adjuster includes a stabilizer connected to the first leg, the first foot, the second leg, and the second foot.

It should also be appreciated from the above, that in various embodiments, the present disclosure provides a joint assembly for a joint between a first concrete slab and a second concrete slab, said joint assembly comprising: a first elongated joint edge member including a slab engagement surface configured to be positioned directly adjacent to a vertically extending plane in which a vertically extending end surface of a first concrete slab will lie; a second separate elongated joint edge member; a plurality of connectors that connect the first and second elongated joint edge members along their length during installation; a plurality of first anchors that extend from the first elongated joint edge member into a region where concrete of the first concrete slab will be poured such that, upon hardening of the first concrete slab, the first anchors are cast within the first concrete slab; a plurality of second anchors that extend from the second elongated joint edge member into a region where concrete of a second concrete slab will be poured such that, upon hardening of the second concrete slab, the second anchors are cast within the second concrete slab; and an elongated attacher including a body defining a series of slots configured to receive pockets, said body having: (a) a first slab engagement surface configured to be positioned inwardly of the substantially vertically extending plane in which the substantially vertically extending end surface of the first concrete slab will lie, and (b) a second slab engagement surface configured to be positioned in substantially the same substantially vertically extending plane in which the substantially vertically extending end surface of the first concrete slab will lie.

In certain such embodiments, the joint assembly is configured to be supported by a reusable multiple position height adjuster during installation, said reusable multiple position height adjuster comprising: (a) a first leg of a first height; (b) a first foot connected to the first leg; (c) a second leg having a second greater height than the first leg and connected to the first leg; and (d) a second foot connected to the second leg, wherein the first leg, the first foot, the second leg, and the second foot are configured to be positioned in a first position such that the first leg extends vertically or substantially vertically, the first foot extends horizontally or substantially horizontally and supports the first and second elongated joint members, and the second leg extends horizontally or substantially horizontally, and wherein the first leg, the first foot, the second leg, and the second foot are configured to be positioned in a second position such that the second leg extends vertically or substantially vertically, the second foot extends horizontally or substantially horizontally and supports the first and second elongated joint members, and the first leg extends horizontally or substantially horizontally.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A reusable multiple position height adjuster for supporting first and second elongated joint members of a joint edge assembly configured to form a joint between two concrete slabs, said reusable multiple position height adjuster comprising:

(a) a first leg of a first height;
(b) a first foot connected to the first leg;
(c) a first toe connected to the first foot;
(d) a second leg having a second greater height than the first leg and connected to the first leg,
(e) a second foot connected to the second leg;
(f) a second toe connected to the second foot; and
(g) a stabilizer connected to the first leg, the first foot, the first toe, the second leg, the second foot, and the second toe, wherein the first leg, the first foot, the first toe, the second leg, the second foot, and the second toe are configured to be positioned in a first position such that the first leg extends vertically or substantially vertically, the first foot extends horizontally or substantially horizontally and supports the first and second elongated joint members, the first toe extends from the first foot upwardly or substantially upwardly and above the first foot in a direction facing away from the second leg, and the second leg extends horizontally or substantially horizontally, and wherein the first leg, the first foot, the first toe, the second leg, the second foot, and the second toe are configured to be positioned in a second position such that the second leg extends vertically or substantially vertically, the second foot extends horizontally or substantially horizontally and supports the first and second elongated joint members, the second toe extends from the second foot upwardly or substantially upwardly and above the second foot in a direction facing away from the first leg, and the first leg extends horizontally or substantially horizontally.

2. The reusable multiple position height adjuster of claim 1, which is made from a plastic.

3. The reusable multiple position height adjuster of claim 1, wherein the first leg defines suitable fastener openings.

4. The reusable multiple position height adjuster of claim 1, wherein the second leg defines suitable fastener openings.

5. A reusable multiple position height adjuster for supporting first and second elongated joint members of a joint edge assembly configured to form a joint between two concrete slabs, said reusable multiple position height adjuster comprising:

(a) a first leg of a first height;
(b) a first foot connected to the first leg;
(c) a first toe connected to the first foot;
(d) a second leg having a second greater height than the first leg and connected to the first leg;
(e) a second foot connected to the second leg;
(f) a second toe connected to the second foot; and
(g) a stabilizer connected to the first leg, the first foot, the first toe, the second leg, the second foot, and the second toe, wherein a portion of the first leg that is connected to a portion of the second leg is also connected to the stabilizer, wherein the first leg, the first foot, the second leg, and the second foot are configured to be positioned in a first position such that the first leg extends vertically or substantially vertically, the first foot extends horizontally or substantially horizontally and supports the first and second elongated joint members, and the second leg extends horizontally or substantially horizontally, and wherein the first leg, the first foot, the second leg, and the second foot are configured to be positioned in a second position such that the second leg extends vertically or substantially vertically, the second foot extends horizontally or substantially horizontally and supports the first and second elongated joint members, and the first leg extends horizontally or substantially horizontally.

6. The reusable multiple position height adjuster of claim 5, which is made from a plastic.

7. The reusable multiple position height adjuster of claim 5, wherein the first leg defines suitable fastener openings.

8. The reusable multiple position height adjuster of claim 5, wherein the second leg defines suitable fastener openings.

9. The reusable multiple position height adjuster of claim 5, wherein when the first leg, the first foot, the second leg, and the second foot are positioned in the first position, the first toe extends vertically or substantially vertically, and wherein when the first leg, the first foot, the second leg, and the second foot are positioned in the second position, the second toe extends vertically or substantially vertically.

10. A reusable multiple position height adjuster for supporting first and second elongated joint members of a joint edge assembly configured to form a joint between two concrete slabs, said reusable multiple position height adjuster comprising:

(a) a first leg of a first height, the first leg defining suitable fastener openings;

(b) a first foot connected to the first leg;

(c) a first toe connected to the first foot;

(d) a second leg having a second greater height than the first leg and connected to the first leg, the second leg defining suitable fastener openings;

(e) a second foot connected to the second leg;

(f) a second toe connected to the first foot; and (g) a stabilizer connected to the first led, the first foot, the first toe, the second leg, the second foot, and the second toe, wherein the first leg, the first foot, the second leg, and the second foot are configured to be positioned in a first position such that the first leg extends vertically or substantially vertically, the first foot extends horizontally or substantially horizontally and supports the first and second elongated joint members, the first toe extends from the first foot upwardly or substantially upwardly and above the first foot in a direction facing away from the second leg, and the second leg extends horizontally or substantially horizontally, wherein the first leg, the first foot, the second leg, and the second foot are configured to be positioned in a second position such that the second leg extends vertically or substantially vertically, the second foot extends horizontally or substantially horizontally and supports the first and second elongated joint members, the second toe extends from the second foot upwardly or substantially upwardly and above the second foot in a direction facing away from the first leg, and the first leg extends horizontally or substantially horizontally, wherein at least one of the suitable fastener openings of the second leg is configured to receive a fastener usable to secure the first position, and wherein at least one of the suitable fastener openings of the first leg is configured to receive the fastener usable to secure the second position.

11. The reusable multiple position height adjuster of claim 10, which is made from a plastic.

* * * * *